US007170477B2

(12) United States Patent
Okamoto et al.

(10) Patent No.: US 7,170,477 B2
(45) Date of Patent: Jan. 30, 2007

(54) IMAGE REPRODUCING METHOD, IMAGE DISPLAY APPARATUS AND PICTURE SIGNAL COMPENSATION DEVICE

(75) Inventors: Shigetsugu Okamoto, Toride (JP); Michiyuki Sugino, Chiba (JP)

(73) Assignee: Sharp Kabushiki Kaisha, Osaka (JP)

( * ) Notice: Subject to any disclaimer, the term of this patent is extended or adjusted under 35 U.S.C. 154(b) by 133 days.

(21) Appl. No.: 09/835,194

(22) Filed: Apr. 13, 2001

(65) Prior Publication Data

US 2001/0035850 A1 Nov. 1, 2001

(30) Foreign Application Priority Data

Apr. 13, 2000 (JP) ..... 2000-112547
Apr. 13, 2000 (JP) ..... 2000-112634

(51) Int. Cl.
*G09G 3/30* (2006.01)

(52) U.S. Cl. ..... 345/77; 345/55; 345/82; 345/87; 345/89

(58) Field of Classification Search ..... 345/30, 345/50–51, 55, 73–77, 82, 84, 87–89, 92
See application file for complete search history.

(56) References Cited

U.S. PATENT DOCUMENTS 5,546,134 A * 8/1996 Lee ..... 348/673
5,550,560 A * 8/1996 Kanada et al. ..... 345/156
5,699,127 A * 12/1997 Ando et al. ..... 348/678
5,734,362 A * 3/1998 Eglit ..... 345/89
5,760,843 A * 6/1998 Morimura et al. ..... 348/678
6,075,574 A * 6/2000 Callway ..... 348/673
6,111,559 A * 8/2000 Motomura et al. ..... 345/102
6,278,436 B1 * 8/2001 Hosoi et al. ..... 345/30
6,289,162 B1 * 9/2001 Uehara et al. ..... 386/1
6,399,960 B1 * 6/2002 Yamazaki et al. ..... 257/59
6,608,610 B2 * 8/2003 Nagai ..... 345/63
2001/0033260 A1 * 10/2001 Nishitani et al. ..... 345/87

FOREIGN PATENT DOCUMENTS

JP 5-64037 3/1993
JP 5-145942 6/1993

(Continued)

*Primary Examiner*—Richard Hjerpe
*Assistant Examiner*—Leonid Shapiro
(74) *Attorney, Agent, or Firm*—David G. Conlin; Steven M. Jensen; Edwards Angell Palmer & Dodge LLP

(57) ABSTRACT

When reproducing an image by a display apparatus having a plurality of pixels, in an average signal level operation circuit is performed an operation to obtain an average signal level which is an average level of all the pixel signals in a picture signal including a pixel signal representing information of a pixel, then, according to this average signal level, in an input signal-output brightness property setting circuit is set an input signal-output brightness property representing variations in brightness of a pixel with respect to a level of the pixel signal, then, the compensation of the picture signal is performed either to satisfy the input signal-output brightness property thus set in a signal compensation section or to allow variations in maximum output brightness of a pixel of the display apparatus according to the average signal level in a maximum output brightness adjustment circuit, so as to output the picture signal subject to compensation to the display apparatus.

25 Claims, 14 Drawing Sheets

FOREIGN PATENT DOCUMENTS

| | | | |
|---|---|---|---|
| JP | 06-006820 | * | 1/1994 |
| JP | 7-109456 | | 11/1995 |
| JP | 08-009197 | | 1/1996 |
| JP | 08-190362 | | 7/1996 |
| JP | 08-190363 | | 7/1996 |
| JP | 08-194450 | | 7/1996 |
| JP | 08-205049 | | 8/1996 |
| JP | 08-223507 | | 8/1996 |
| JP | 2590931 | | 12/1996 |
| JP | 09-154042 | | 6/1997 |
| JP | 10-126648 | | 5/1998 |
| JP | 10-243261 | | 9/1998 |
| JP | 11-305734 | | 11/1999 |
| JP | 11-327496 | | 11/1999 |
| JP | 2000-13714 | | 1/2000 |
| JP | 2000-020013 | | 1/2000 |
| JP | 2000-098995 | | 4/2000 |
| JP | 2000-278556 | | 10/2000 |
| JP | 2000-284739 | | 10/2000 |
| JP | 2000-513907 | | 10/2000 |
| JP | 2000-338922 | | 12/2000 |
| JP | 2002-041007 | | 2/2002 |

* cited by examiner

IMAGE REPRODUCING METHOD, IMAGE DISPLAY APPARATUS AND PICTURE SIGNAL COMPENSATION DEVICE

FIELD OF THE INVENTION

The present invention relates to an image reproducing method for reproducing an image by a display apparatus, and an image display apparatus having a function to adjust output brightness of a display (display apparatus) when reproducing an image, and a display picture signal compensation device, and in particular to an image reproducing method, an image display apparatus and a picture signal compensation device which are capable of image reproduction with high definition.

BACKGROUND OF THE INVENTION

Conventionally, gamma adjustment and brightness adjustment in correspondence with an input picture signal have been available in an image display apparatus. The gamma adjustment adjusts an input signal-output brightness property (a variation in an output brightness to a variation in an input signal; it is called a gamma property) of an image display apparatus. By such adjustments to control brightness, a nuance of color (chromaticity) and a contrast ratio of an output image, an image substantially equal to an inputted original image can be displayed. In addition, it is also possible to freely control an image quality; for example, an image which is subject to a contrast ratio control with respect to an inputted original image can be displayed.

A gamma adjustment technique in connection with a liquid crystal display apparatus is disclosed in Japanese Unexamined Patent Publication No. 126648/1998 (Tokukaihei 10-126648 published on May 15, 1998). A gamma adjustment circuit disclosed in the publication 10-126648 converts an input analog picture signal into a digital signal by an AD (analog-digital) converter so as to adjust gamma, where the input analog picture signal is amplified at an amplification degree with is selected in accordance with a width (range of an analog input voltage) of the AD converter, thereafter converting it into an digital signal by the AD converter, then, gamma adjustment is performed in accordance with a gamma adjustment property which is determined in relation to selected information of the amplification degree. With this arrangement, it is possible to perform gamma adjustment in a broad range and with high accuracy in conversion processing of a small number of bits, thereby reducing the cost of a circuit necessary for performing gamma adjustment in a broad range and with high accuracy.

Further, Japanese Unexamined Patent Publication No. 64037/1993 (Tokukaihei 5-64037 published on Mar. 12, 1993) discloses a gamma adjustment circuit to perform appropriate gamma adjustment processing with respect to signals of colors R (red), G (green) and B (blue), by obtaining, based on a transmissivity property measured by a brightnessmeter, an appropriate gamma adjustment curve for a liquid crystal display apparatus so as to have a linear function representing an input voltage-output brightness property.

Furthermore, Japanese Unexamined Patent Publication No. 145942/1993 (Tokukaihei 5-145942 published on Jun. 11, 1993) discloses a gamma adjustment technique in connection with a CRT (Cathode Ray Tube) display device, where color control is performed together with gamma adjustment, by measuring gamma properties of colors R, G and B of a CRT display device so as to equalize values of a brightness ratio of the levels of RGB signals, using the measured gamma properties.

Further, Japanese Examined Patent Publication No. 109456/1995 (Tokukohei 7-109456 published on Nov. 22, 1995; corresponding to Japanese Unexamined Patent Publication No. 158416/1989 that is Tokukaihei 1-158416 published on Jun. 21, 1989) discloses a brightness control technique for a color light source in a liquid crystal display, where, in order to prevent an image with the unbalanced look of colors due to reduction in spectral luminous efficiency of each of colors R, G and B in low light, there are provided a first brightness control means for controlling brightness level of an emission element group for each of the colors R, G and B, and a second brightness control means for controlling a balance of brightness levels among a green-color emission element group, a red-color emission element group and a blue-color emission element group, in accordance with the brightness level controlled by the first brightness control means.

Conventionally, the CRT display device is generally arranged to receive a picture signal subject to an inverse gamma compensation. The inverse gamma compensation is such that, in order to attain direct proportionality between an intensity of light in an original image and brightness of each pixel in an image display apparatus, a picture signal is adjusted employing an inverse function of a non-linear function representing an input signal-output brightness property (gamma property) of an image display apparatus. A non-linear function representing a gamma property of the CRT display device can be shown in approximate representation by an exponential function, where a value of the exponential function called a gamma value is generally about 2.2 or so. Accordingly, to the CRT display device is inputted a picture signal subject to the inverse gamma compensation, under the condition that a gamma value is generally 2.2.

Using two types of CRT display devices D and E by different manufacturers, which are commercially available, variations in a gamma value $\gamma(G)$ and maximum output brightness $i_{max}(G)$ with respect to an average input signal level of brightness G (average signal level of brightness of an input picture signal on a whole screen) are measured, results of which are shown in FIG. 10. Note that, among curves shown in FIG. 10, a curve $\gamma D$ represents a gamma value $\gamma(G)$ of one type of the CRT display device D, a curve $\gamma E$ represents a gamma value $\gamma(G)$ of the other type of the CRT display device E, a curve $i_{max}D$ represents maximum output brightness $i_{max}(G)$ of the CRT display device D, a curve $i_{max}E$ represents maximum output brightness $i_{max}(G)$ of the CRT display device E. In addition, the average input signal level of brightness G is a relative value whose maximum value is 100%, and the maximum output brightness is a value normalized to have a maximum value of 1.

As is clear from measurement data shown in FIG. 10, in the majority of input images having the average input signal level of brightness G within a fixed range, the maximum output brightness $i_{max}(G)$ and the gamma value $\gamma(G)$ are substantially constant; on the other hand, in an input image having the average input signal level of brightness G which is out of the range, the maximum output brightness $i_{max}(G)$ decreases.

According to FIG. 10, when the average input signal level of brightness G is about 60%, the actually measured gamma value $\gamma(G)$ is also about 2.2. Consequently, in that case, the CRT display device accurately reproduces an image in which an inputted picture signal is linearly processed, that is, an original image (picked up image) prior to the inverse gamma compensation.

However, when the average input signal level of brightness G is less than about 60%, or when it is more than about 60%, the gamma value γ(G) of an image output of the CRT display device does not show 2.2, which results in incomplete linear processing, thus failing to obtain an accurate reproduction of an original image (picked up image) on a display.

However, the inventors of the present application have examined and revealed that with such a display property, as shown in FIG. 12, when the average input signal level of brightness is low, an input signal-output brightness property has output brightness in a dark portion which has relatively been increased, thereby attaining an advantage in display, that is, an improvement in visibility in the dark portion.

Further, the inventors of the present invention have examined and revealed that, as shown in FIG. 13, with the foregoing display property, when the average input signal level of brightness is high, the input signal-output brightness property becomes such that output brightness in a bright portion is relatively reduced, and output brightness in an entire screen is relatively reduced. Therefore, in the bright portion are prevented bleached-looking display and glare, thereby improving visibility.

It is commonly unrecognized that the foregoing display property of the CRT display device improves visibility of an image on display. Note that, not all the CRT display devices show this display property, but it is common in a CRT display device to show the display property like this because it has a circuit (automatic brightness limiting circuit) for limiting an increase in a driving current in accordance with an increase in brightness on display, so as to prevent a CRT from being burnt due to the increase in a driving current that is typical of the CRT display device.

On the other hand, in a display apparatus including an emission element such as a backlight, and a light switching element such as a liquid crystal panel, for example, in a liquid crystal display device, when reproducing a picture signal in the display apparatus, the maximum brightness of an image on display is determined substantially according to output of an emission element, and an input signal-output brightness property is determined substantially according to a characteristic of a light switching element. Here, the maximum brightness of an image on display and the input signal-output brightness property are the properties independent from each other. Moreover, in such a display apparatus, as is clear from FIG. 11 showing measurement results of a liquid crystal display device, the maximum output brightness $i_{max}(G)$ of an image on display and an exponential value (a gamma value) γ(G) in which a non-linear function representing the input signal-output brightness property is approximately represented by an exponential function are constant, regardless of an average input signal level of brightness G of an input signal (it is substantially equal to an input signal level of brightness H in a background).

Here, according to the inventors' subjective comparison between the display property (brightness property) of the foregoing consumer-oriented CRT display device and the display property (brightness property) of the foregoing liquid crystal display device, it has been confirmed that such a display property (brightness property) as in the CRT display device is more desirable in terms of a natural image quality.

FIG. 11 shows an input signal-output brightness property obtained as a result of an inverse gamma compensation of an input picture signal and a compensation of a voltage-optical conversion property of a liquid crystal (compensation for a deviation from a linear property), that were performed by a signal processing circuit in the liquid crystal display device.

When inputting a picture signal which is subject to an inverse gamma compensation, such as a picture signal transmitted from a TV broadcast station, to a liquid crystal display device having an input signal-output brightness property as shown in FIG. 11, an output brightness property of an image reproduced on a display surface of the liquid crystal display device becomes the one as shown in FIG. 14.

With this output brightness property, the normalized brightness becomes much higher than a linear property in a portion where brightness is high, i.e., where a normalized signal level of brightness is not less than 0.4. With this output brightness property is obtained an image which gives the impression that a whole image looks bleached and out of focus when viewed, thus failing to properly reproduce an input image.

Furthermore, with an output brightness property of an image reproduced as shown in FIG. 11, when displaying an image having high average brightness, brightness as a whole becomes high. Therefore, a viewer feels that a whole screen is so glaring that he or she cannot fully recognize a slight difference in brightness in a bright portion, thereby being given the impression that the screen is apparently in a state of whiteout. Further, on the contrary, when displaying a dark image having low average brightness, though a dark portion is reproduced substantially according to the linear property, yet a screen is entirely dark, thereby giving a viewer the impression that visibility in the dark portion is insufficient.

On the other hand, in a CRT display device, maximum output brightness is relatively high when average brightness is low, thereby giving the impression that visibility in a dark portion is relatively favorable. Further, when displaying an entirely bright image having high average brightness, maximum output brightness becomes relatively low, thereby suppressing glare and slightly improving visibility of a whole screen.

Such deficiencies in visibility and color tone, such as a bleach-looking screen, due to a display property are pronounced among a CRT display device, a flat display device including a liquid crystal display and a plasma display, and a projection-type display device.

Meanwhile, the foregoing conventional gamma compensation technique has a presupposition that a gamma property of a display apparatus is invariable regardless of a type of an image, and therefore, compensation is performed at the same setting value (gamma value) with respect to any images. This prevents compensation of a deficiency in visibility in the liquid crystal display device as above.

Further, since the foregoing conventional brightness control technique concerns an output adjustment to a color light source, a level of a picture signal to be inputted to a liquid crystal display has not been considered at all. Therefore, this technique also cannot compensate for a deficiency in visibility in the liquid crystal display device as above.

Essentially, a minimum requirement for accurate reproduction of a display image from an input signal is the ability to show a substantially linear input signal-output brightness property on an image display surface of a display apparatus. Further, in order to attain a picture which looks natural to a viewer, one feasible arrangement is such that an I/O property such as a brightness property and a color-tone property of image reproduction can be adjusted arbitrarily; however, with this arrangement, there arises problems such as a complication to an arrangement of signal processing circuitry in an image display apparatus, and an increase in cost.

SUMMARY OF THE INVENTION

It is an object of the present invention to reproduce an image with a high display quality. In addition, a further object of the present invention is to provide an image reproducing method, an image display apparatus and a picture signal compensation device which are capable of reproducing an image with a high display quality.

The present invention attains the foregoing object by setting maximum output brightness and/or an input signal-output brightness property of a display device (display section) in accordance with an average signal level of an inputted picture signal.

More specifically, in order to attain the foregoing object, an image reproducing method according to the present invention for reproducing an image by a display apparatus having a plurality of pixels based on a picture signal including a pixel signal representing information of each pixel, includes the steps of: performing an operation to obtain an average signal level which is an average level of all the pixel signals, then, setting an input signal-output brightness property which represents variations in brightness of a pixel with respect to the level of a pixel signal in accordance with the average signal level; and reproducing an image so as to satisfy the input signal-output brightness property thus set.

By the foregoing method, for example, even when using a display apparatus (liquid crystal display device, etc.) having a constant input signal-output brightness property regardless of an average signal level, it is possible to reproduce an image having superior visibility in a dark portion of an entirely dark image, and in a bright portion of an entirely bright image. Accordingly, it is thus possible to provide an image reproducing method capable of reproducing an image with a high display quality regardless of whether or not the input signal-output brightness property varies according to an average signal level.

Further, in order to attain the foregoing object, an image reproducing method of the present invention reproduces an image by a display apparatus having a plurality of pixels based on a picture signal including a pixel signal representing information of each pixel, wherein an image is reproduced so that, after performing an operation to obtain an average signal level which is an average level of all the pixel signals, maximum output brightness of a pixel of the display apparatus varies in accordance with the average signal level.

By the foregoing method, for example, even when using a display apparatus (liquid crystal display device, etc.) which has constant maximum output brightness regardless of an input average signal level, it is possible to reduce glare caused by a screen when reproducing an entirely bright image while preventing temporary blindness due to a retinal bleaching phenomenon when directly viewing the screen. Consequently, by the foregoing method, regardless of an average signal level-maximum output brightness property of the display apparatus can be reproduced an image with a high display quality.

In order to attain the foregoing object, an image display apparatus of the present invention which includes a display section having a plurality of pixels for displaying an image and receives a picture signal including a pixel signal representing information of each pixel, includes: an average signal level operation section for performing an operation to obtain an average signal level which is an average level of all the pixel signals; an input signal-output brightness property setting section for setting an input signal-output brightness property which represents variations in brightness of a pixel with respect to a level of the pixel signal in accordance with the average signal level; and a signal compensation section for performing compensation of a picture signal so as to satisfy the input signal-output brightness property thus set.

With the foregoing arrangement, since an input signal-output brightness property can be varied in accordance with an average signal level, for example, when adopting a display section (liquid crystal display device, etc.) having a constant input signal-output brightness property regardless of an average signal level, it is possible to provide an image display apparatus having superior visibility when entirely dark or bright. Consequently, with the foregoing arrangement, it is possible to provide an image display apparatus capable of displaying an image with a high display quality regardless of whether or not the input signal-output brightness property of the display section varies in accordance with an average signal level.

Further, in order to attain the foregoing object, an image display apparatus of the present invention which includes a display section having a plurality of pixels for displaying an image and receives a picture signal including a pixel signal representing information of each pixel, includes: an average signal level operation section for performing an operation to obtain an average signal level which is an average level of all the pixel signals; and a maximum output brightness adjustment section for adjusting maximum output brightness of a pixel of a display section in accordance with the average signal level.

With the foregoing arrangement, since maximum output brightness of a pixel of the display section can be adjusted in accordance with an average signal level, for example, even when adopting a display section (liquid crystal display device, etc.) having constant maximum output brightness regardless of an average signal level, it is possible to reduce glare caused by a screen when displaying an entirely bright image while preventing temporary blindness due to a retinal bleaching phenomenon when directly viewing the screen, thereby providing an image display apparatus having superior visibility in an entirely bright image. Consequently, with the foregoing arrangement, it is possible to provide an image display apparatus capable of displaying an image with a high display quality regardless of an average signal level-maximum output brightness property of the display apparatus.

A maximum output brightness value and/or an input signal-output brightness property in the image display apparatus of the foregoing arrangements can arbitrarily be set in accordance with an average signal level. Therefore, when focusing only this part of the image display apparatus having either of the foregoing arrangements, it is effective in an evaluation of a display quality of various forms of display apparatuses, and an evaluation in the case of applying a high-quality image reproducing parameter to an existing display apparatus.

More specifically, in order to attain the foregoing object, a picture signal compensation device of the present invention which receives a picture signal including a pixel signal representing information of each pixel, and performs compensation of the picture signal so as to output the pictures signal subject to compensation to a display apparatus having a plurality of pixels, includes: an average signal level operation section for performing an operation to obtain an average signal level which is an average level of all the pixel signals; an input signal-output brightness property setting section for setting an input signal-output brightness property which represents variations in brightness of a pixel with respect to a level of the pixel signal in accordance with the average signal level; and a signal compensation section for performing compensation of a picture signal so as to satisfy the input signal-output brightness property thus set.

With the foregoing arrangement, since an input signal-display apparatus output brightness property of the picture signal compensation device can be varied in accordance with an average signal level, for example, even when adopting a display apparatus (liquid crystal display device, etc.) having a constant input signal-output brightness property regardless of an average signal level, it is possible to display an image having superior visibility in a dark portion of an entirely dark image (image having low average brightness) and in a bright portion of an entirely bright image (image having high average brightness). Consequently, with the foregoing arrangement, it is possible to provide a picture signal compensation device capable of displaying an image with a high display quality regardless of whether or not an input signal-output brightness property of the display apparatus varies according to an average signal level.

Further, in order to attain the foregoing object, a picture signal compensation device of the present invention includes: an average signal level operation section for performing an operation to obtain an average signal level which is an average level of all the pixel signals; and a maximum output brightness adjustment section for performing compensation of the picture signal so that maximum output brightness of a pixel of the display apparatus varies in accordance with the average signal level.

With the foregoing arrangement, since maximum output brightness of a pixel of the display apparatus can be adjusted in accordance with an average signal level, for example, even when adopting a display apparatus (liquid crystal display device, etc.) having constant maximum output brightness regardless of an average signal level, it is possible to reduce glare caused by a screen when reproducing an entirely bright image while preventing temporary blindness due to a retinal bleaching phenomenon when directly viewing the screen, thereby improving visibility in the entirely bright image. Consequently, with the foregoing arrangement, it is possible to provide an image display apparatus capable of displaying an image with a high display quality regardless of an average signal level-maximum output brightness property of the display apparatus.

Additional objects, features, and strengths of the present invention will be made clear by the description below. Further, the advantages of the present invention will be evident from the following explanation in reference to the drawings.

DESCRIPTION OF THE EMBODIMENTS

First, the following will explain in detail as to how the inventors of the present application reached the present invention with reference to FIGS. 6 to 9.

Figure 6:
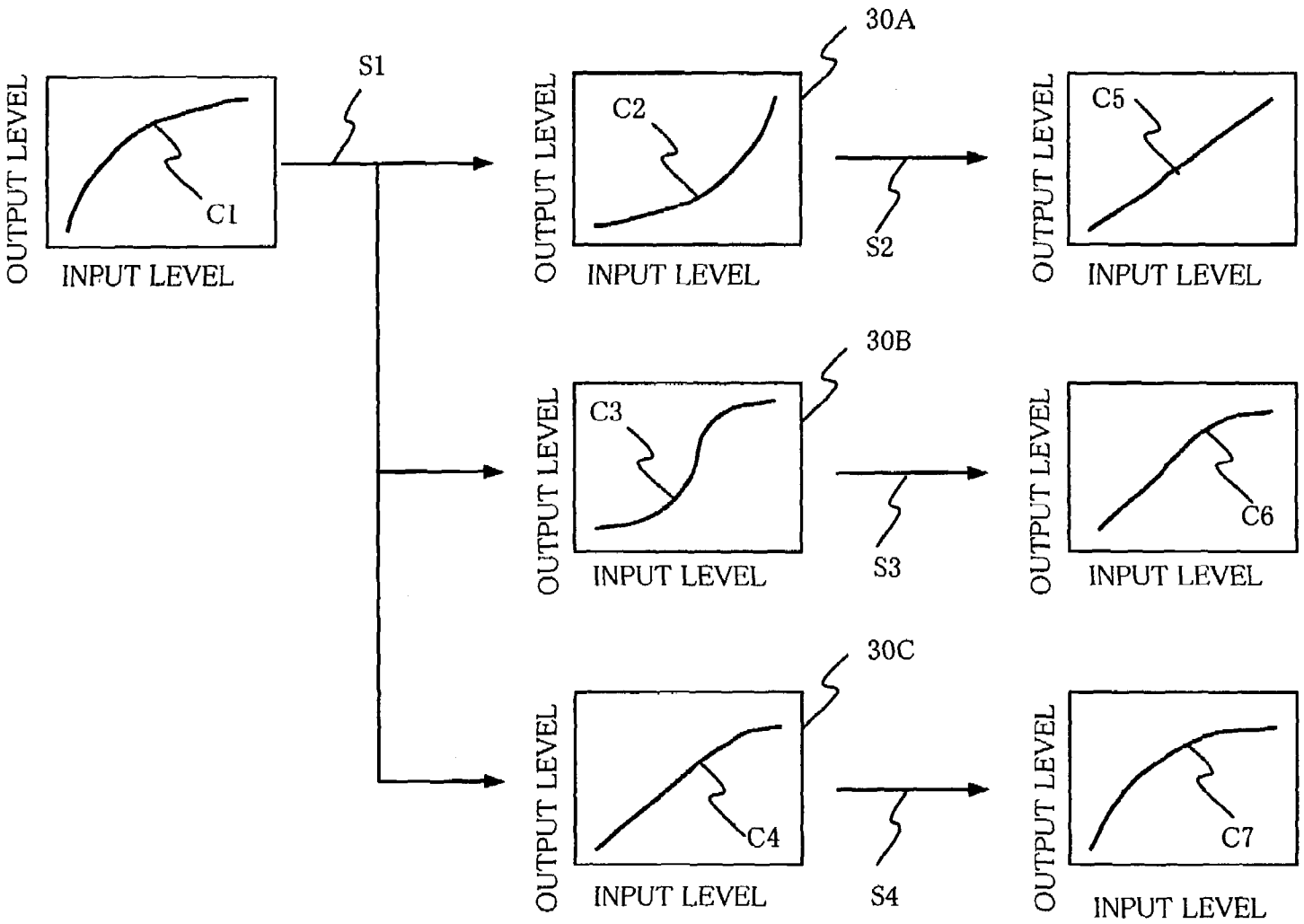
FIG. 6 is an explanatory diagram in schematic form depicting variations in an input signal-output brightness property when outputting a picture signal subject to an inverse gamma compensation via various types of display apparatuses, together with an I/O property of the display apparatuses.
Figure 7:
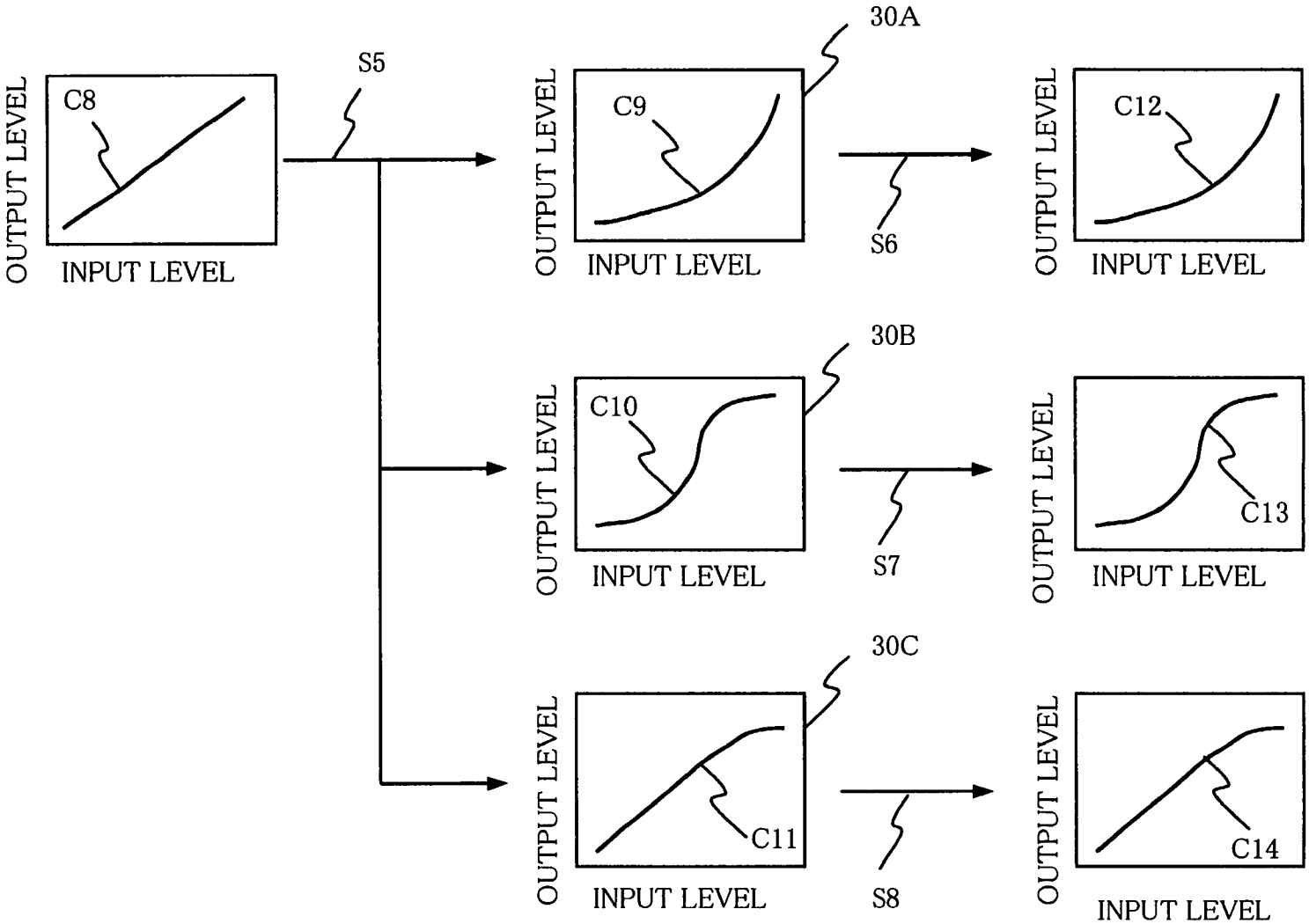
FIG. 7 is an explanatory drawing in schematic form depicting variations in an input signal-output brightness property when outputting a picture signal subject to linear processing via various types of display apparatuses, together with an I/O property of the display apparatuses.

FIGS. 6 and 7 are diagrams in schematic forms depicting display properties of various types of display apparatuses with respect to an inputted picture signal. FIGS. 6 and 7 show states in which picture signals S1 and S5 are respectively inputted to display apparatuses 30A to 30C having three different display properties.

In FIG. 6, there is inputted a picture signal S1 which is subject to an inverse gamma compensation as in the common TV broadcasting. Therefore, a curve C1 representing variations in an output level (voltage level of a picture signal) with respect to an input level (optical intensity of an original image) in the picture signal S1 has such an inclination as to decrease as the input level increases. The general reason the picture signal S1 like this is inputted is as follows: assuming that an image is reproduced in a CRT display device 30A having such a display property that a gamma property as shown by a curve C2, that is, the curve C2 representing an output level (brightness) with respect to an input level (voltage level of a picture signal) has such an inclination as to increase as the input level increases, an inverse gamma compensation is performed so as to cancel out a variation in the inclination. Accordingly, when a display apparatus has a gamma property as in the CRT display device 30A shown in FIG. 6, the output level (brightness) of an image S2 to be outputted (displayed) from the CRT display device 30A varies linearly as shown by a curve C5 with the input level (optical intensity of an original image).

Commonly, a display apparatus has various I/O properties (display properties) with respect to input (optical intensity) from the source of a picture signal (original image). Therefore, there arises a problem such that, when reproducing an input image, which is reproduced substantially accurately in the CRT display device 30A, in different display apparatuses such as a display apparatus 30B having an I/O property as shown by a curve C3 and a display apparatus 30C having an I/O property as shown by a curve C4, images S3 and S4 as shown by curves C6 and C7 having non-linear output levels with respect to the input level from the original image are outputted, thereby failing to accurately reproduce the original image.

Further, in the case of inputting a picture signal S5 whose output level (voltage level of a picture signal) linearly varies with an input level (optical intensity of an original image) as shown by a curve C8 of FIG. 7, for example, when directly inputting image data created by a computer and the like and when compensation is not performed on the inputted picture signal S5, the picture signal S5 is converted into an image having a property in accordance with an I/O property of the display apparatuses 30A to 30C as shown by curves C9 to C11, respectively, so as to be outputted. Accordingly, in the display apparatuses 30A to 30C, as shown by curves C12 to C14, S6 to S8 having non-linear output levels with respect to the input level from the original image are outputted. It is thus clear that the original image (inputted image) cannot accurately be reproduced on the display screens of the display apparatuses 30A to 30C.

The following will describe an I/O property of the foregoing display apparatuses (display devices) further in detail.

In a display apparatus such as a CRT display device, an input signal voltage-output brightness conversion property is commonly called a gamma (γ) property, that is defined as the following equation (1):

$$I=(V-a)^{\gamma}+b \tag{1}$$

Here, I is output brightness, V is an input signal voltage, and an exponential value γ is a non-linear parameter called a gamma value. In addition, a and b are offset constants.

The following will discuss the case where an input signal is a common TV picture signal which is subject to an inverse gamma compensation by a brightness-signal voltage conversion method specified according to the SMPTE standard 170M or 240M, the television standard specified by the Society of Motion Picture and Television Engineers (SMTPE) of the United States, or the radio law/CCIR (International Radio Consultative Committee) Recommendation 624/RS170A that has been a conventional method. This TV picture signal is subjected to the inverse gamma compensation on the assumption that it would be inputted to a CRT display device in which γ=2.2. Therefore, when displaying in the CRT display device, the original image is outputted in a substantially linear state without any special processing under a fixed condition. The input signal voltage has a substantially direct proportional relation with an input signal level of brightness. Therefore, when g is an input signal level of brightness which is subject to the inverse gamma processing and, for simplification, a=b=0 in equation (1), equation (1) is rewritten using maximum brightness (maximum output brightness) $i_{max}$ which can be obtained when g has a maximum value, that can be defined as the following equation (2):

$$I=i_{max}\cdot g^{\gamma} \tag{2}$$

This enables a relation between input and output to be free from limitation of a display apparatus and taken into consideration in terms of signal processing. Here, in order to explain a concept, a constant term of equation (1) is omitted; however, based on equation (1) intact, a property of a CRT display device may be described further in detail, thereby improving the accuracy of equation to be discussed below.

In a CRT display device for example, maximum output brightness $i_{max}$ in each family is structurally determined in accordance with an average input signal level of brightness G. Therefore, when rewriting maximum brightness $i_{max}$ in equation (2) into a function $i_{max}$ (G) of average input signal level of brightness G, I becomes a function of g and G, which can be defined as the following equation (3):

$$I(g,G)=i_{max}(G)\cdot g^{\gamma} \tag{3}$$

Here, the average input signal level of brightness G is an average value of a signal level of brightness $g_{xy}$ to be inputted in correspondence with each pixel P(x, y) of a display apparatus, that can be defined as the following equation:

$$G = AVE(g_{xy}) = \frac{1}{i\cdot j}\sum_{x=1,y=1}^{i,j}(g_{xy}) \tag{4}$$

Note that, pixel P(x, y) represents a pixel on row x(1≦x≦i), column y (1≦y≦i) of a plurality of pixels aligned in matrix of row i (i≧2)×column j (j≧2).

Figure 8:
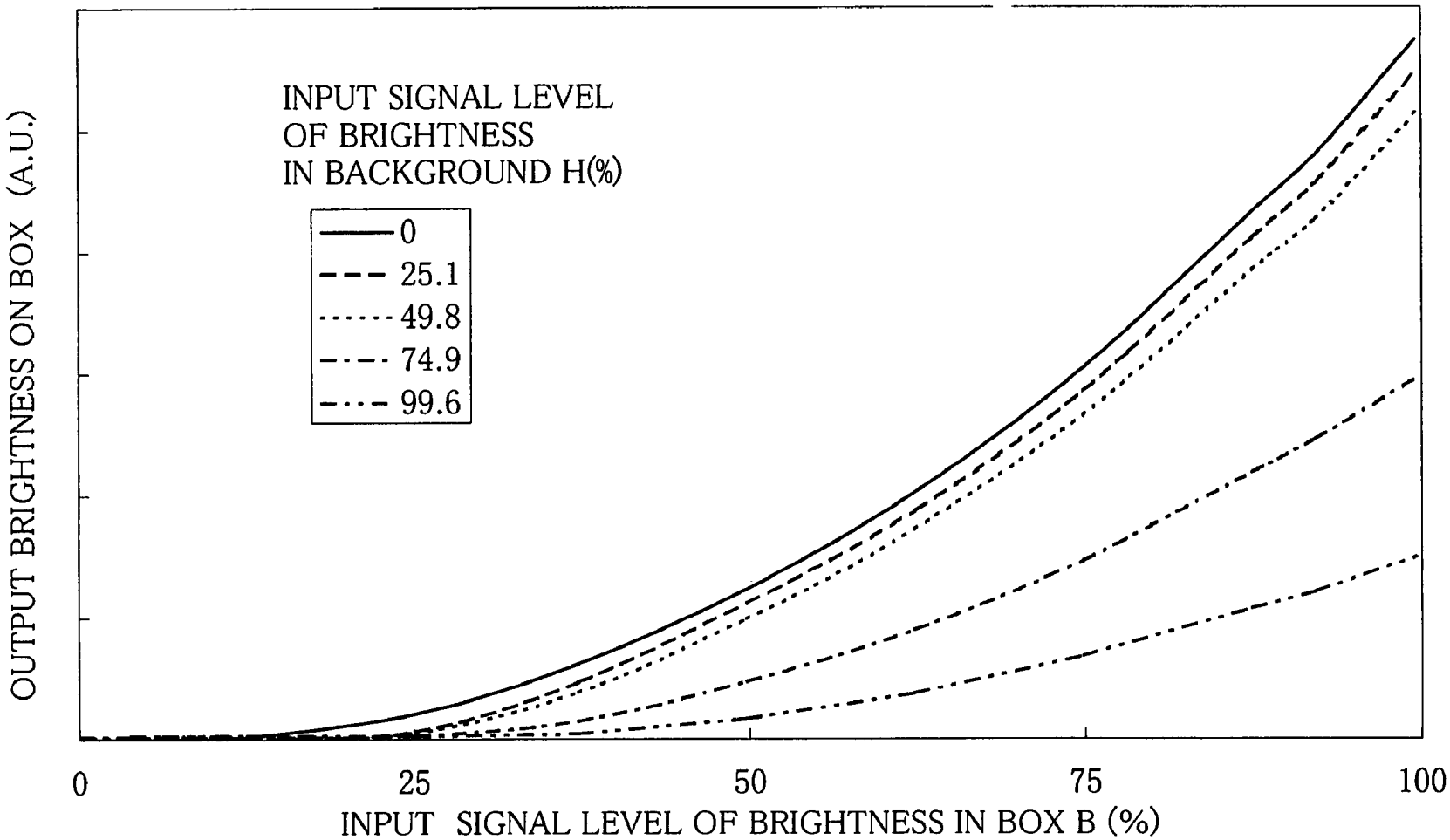
FIG. 8 is a graph showing variations in output brightness on a box with respect to an input signal level of brightness in the box when an input signal level of brightness in a background of a CRT display device is constant.
Figure 9:
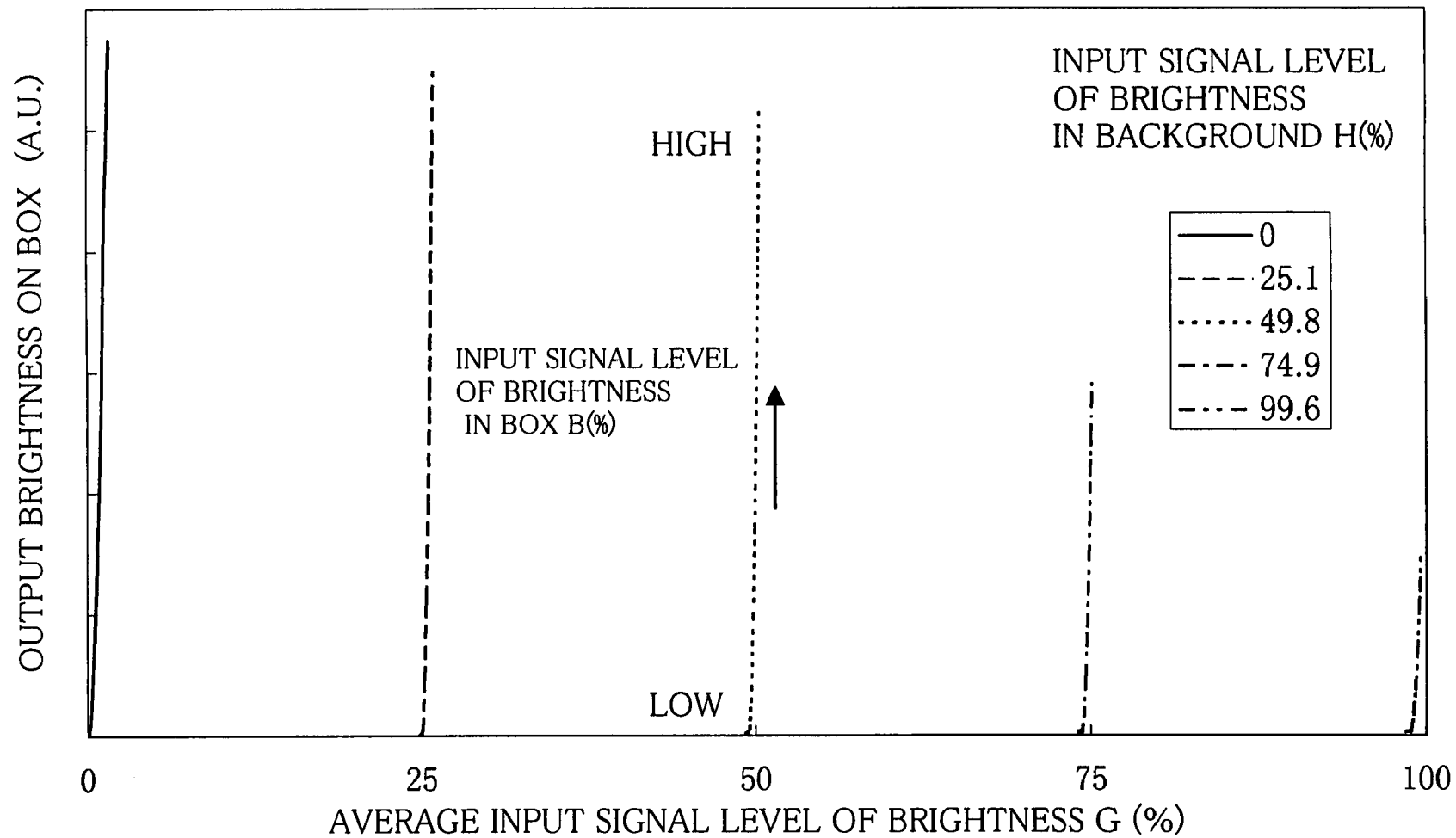
FIG. 9 is a graph showing variations in output brightness on a box with respect to an average input signal level of brightness in a CRT display device.
Figure 10:
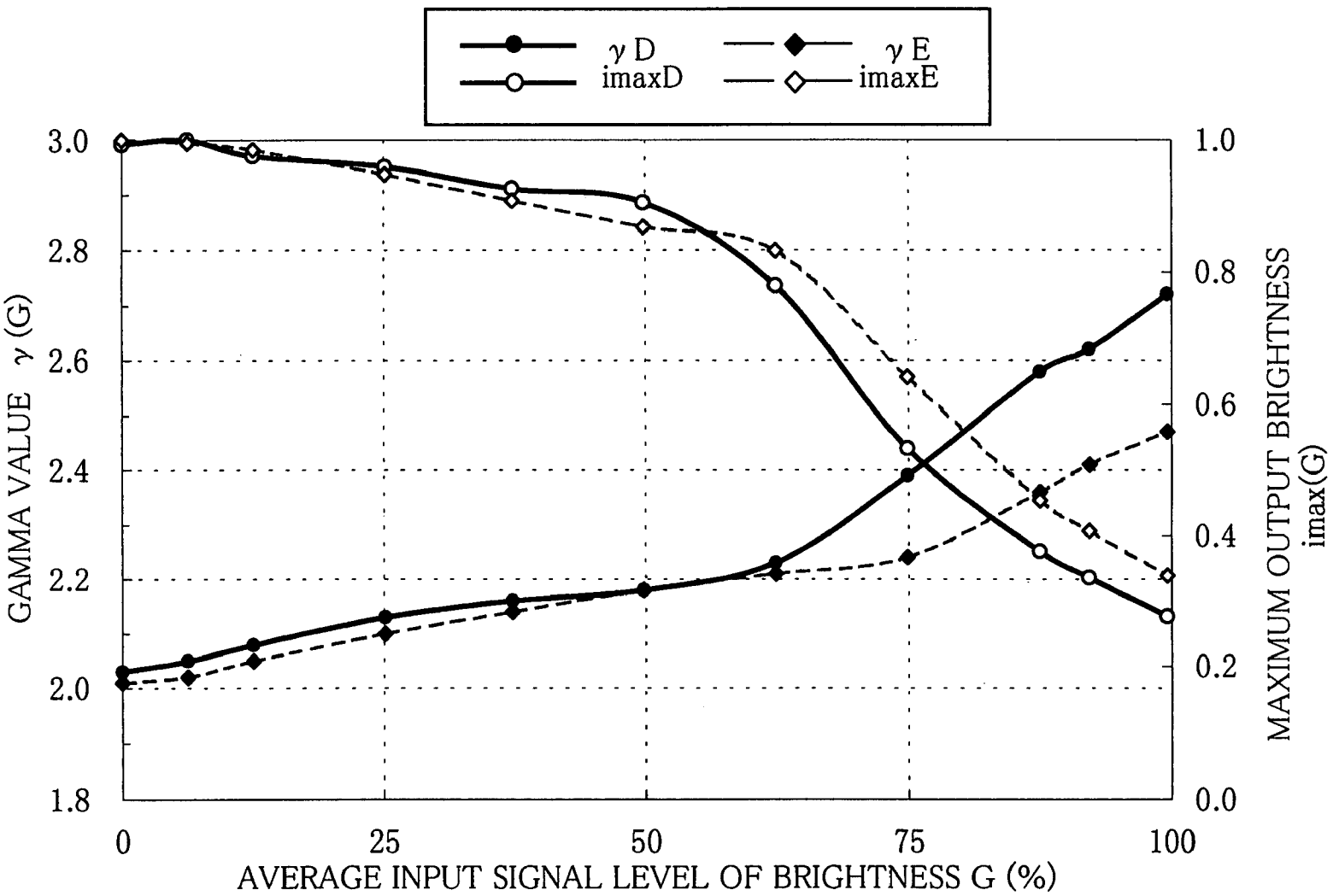
FIG. 10 is a graph showing variations in normalized maximum output brightness and gamma value with respect to an average input signal level of brightness in a CRT display device.

In a common CRT display device, however, as shown in FIGS. 8 and 9, when investigating variations in maximum output brightness $i_{max}$ and a gamma value γ with respect to an average input signal level of brightness G, then as shown in FIG. 10, not only the maximum output brightness $i_{max}$ but also the gamma value γ varies as the average input signal level of brightness G varies. Accordingly, like the maximum output brightness $i_{max}$, the gamma value γ also requires to be rewritten into a function of the average input signal level of brightness G.

More specifically, according to a property shown in FIG. 8, equation (3) can be written into the following equation (5):

$$I(g,G)=i_{max}(G)\cdot g^{\gamma(G)} \tag{5}$$

As is clear from equation (5), when setting the maximum output brightness $i_{max}$(G) and the gamma value γ(G) in accordance with the average input signal level of brightness G, it is possible to perform display with respect to an input signal of brightness in a display apparatus other than the CRT display device according to the same I/O property as that of the CRT display device, and to reproduce an image according to an I/O property with higher reproducibility.

Here, when defining a function D which represents a normalized input signal-output brightness property of an arbitrary display apparatus with a normalized input signal level of brightness $g_{input}$ and a normalized output level of brightness $g_{output}$, the following relation holds:

$$g_{output}=D(g_{input}) \tag{6}$$

Here, the reason the signal levels and the properties were normalized is that there can be assumed the case where a signal to be inputted and a signal to be outputted have a difference in accuracy depending on a type of a display apparatus and the case where a scale of output brightness varies depending on a type of a display apparatus. More specifically, adjustment in a display apparatus may possibly cause the scale of output brightness that is 10 at a certain setting value to be 20 at a different setting value, for example, when an input signal has 8 bits and an output signal has 10 bits, or when an input signal has 8 bits and an output signal has 6 bits.

In actual signal processing, by previously normalizing the values $g_{input}$, $g_{output}$ and $i_{max}$ to be in a range of 0 to 1, in order to perform a final conversion into the form of a signal, operational results need to be multiplied by the number of maximum expression of a signal (when using a digital signal having n bits, the number of maximum expression is $2^n-1$), thereby readily performing calculation.

As discussed, in order to obtain optimum output on display, various types of picture signals should be adjusted to an input picture signal.

FIRST EMBODIMENT

Figure 1:
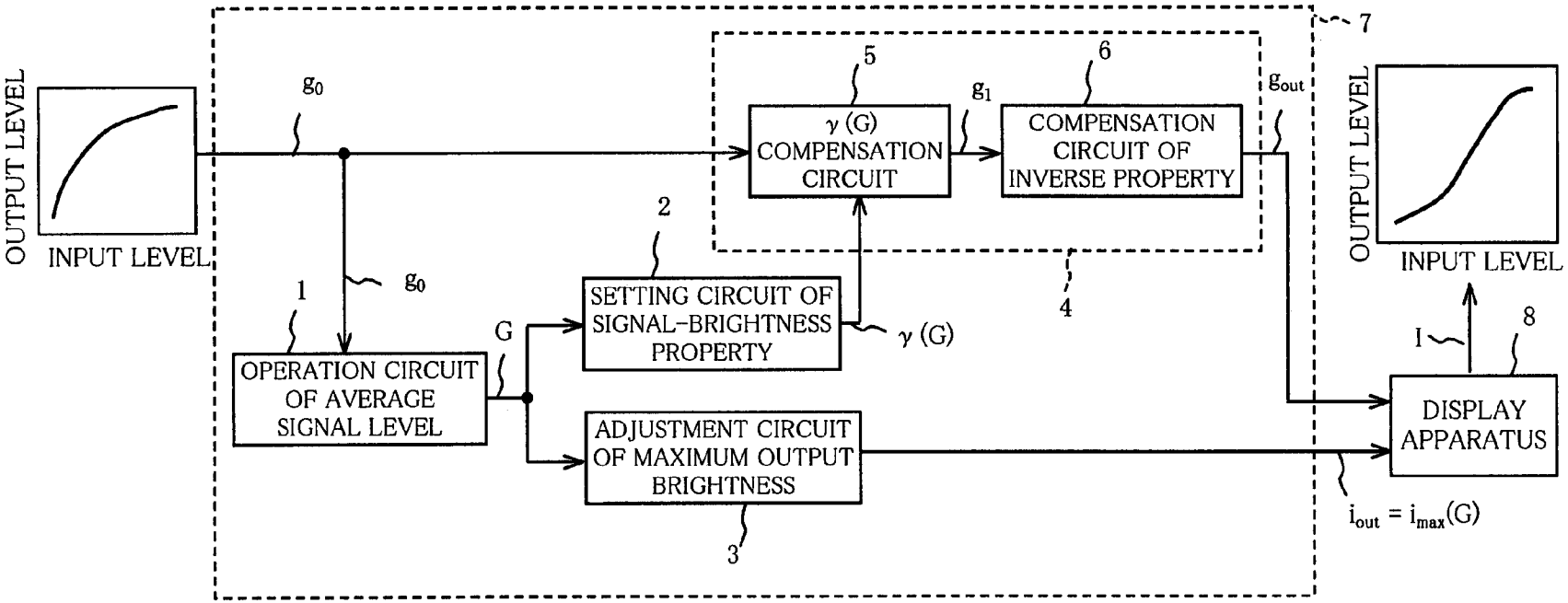
FIG. 1 is a block diagram schematically showing a structure of an image display apparatus to be adopted in an image reproducing method according to one embodiment of the present invention.

The following will explain one embodiment of the present invention with reference to FIG. 1.

As shown in FIG. 1, an image display apparatus of the present embodiment includes a display apparatus (display section) 8 having a plurality of pixels (not shown) for displaying an image; and a picture signal compensation device 7, where a picture signal $g_0$ (signal level of brightness $g_0$) which includes a pixel signal representing information on each pixel is inputted to the display apparatus 8 via the picture signal compensation device 7.

The picture signal compensation device 7 includes an operation circuit of average signal level ("average signal level operation circuit", hereinafter; average signal level operation section) 1 for performing an operation on an average level of all the pixel signals as an average input signal level of brightness G, a setting circuit of signal-brightness property ("input signal-output brightness property setting circuit", hereinafter; input signal-output brightness property setting section) 2 for setting an input signal-output brightness property representing variations in brightness of a pixel with respect to a level of a pixel signal, in accordance with an average input signal level of brightness G, an adjustment circuit of maximum output brightness ("maximum output brightness adjustment circuit", hereinafter; maximum output brightness adjustment section) 3 for adjusting maximum output brightness of a pixel in the display apparatus 8 in accordance with an average input signal level of brightness G, and a signal compensation section 4 for compensating a picture signal $g_0$ so as to satisfy an input signal-output brightness property which was set.

The signal compensation section 4 is made up of a γ(G) compensation circuit (first signal compensation section) 5 for compensating the picture signal $g_0$ according to an I/O property which is the same as the set input signal-output brightness property, and a compensation circuit of inverse property ("inverse property compensation circuit", hereinafter; second signal compensation circuit) 6 for further compensating a picture signal $g_1$ according to an I/O property which is the property opposite to the I/O property (input signal-output brightness property) of the display apparatus 8.

Next, the following will explain one image reproducing method according to the present embodiment, that is, an image reproducing method adopting the foregoing image display apparatus.

First, in the average signal level operation circuit 1, an operation is performed on a brightness signal level $g_0$ of an input picture signal $g_0$ subject to the inverse gamma compensation so as to obtain an average input signal level of brightness G.

Next, in the input signal-output brightness property setting circuit 2, an operation is performed on the average input signal level of brightness G so as to obtain an exponential value (gamma value) γ(G) in which an input signal-output brightness property of the image display apparatus is approximately represented by an exponential function. More specifically, as in the case of the curve γD of FIG. 10 for example, the exponential value (gamma value) γ(G) in which the input signal-output brightness property of the image display apparatus is approximately represented by the exponential function is set to become larger as the average input signal level of brightness G increases.

Further, in the signal compensation section 4, an input picture signal (picture signal $g_0$) is compensated so that an exponential value (gamma value) in which the input signal-output brightness property of the image display apparatus is approximately represented coincides with a setting value γ(G) thereof, then, the picture signal $g_0$ subject to compensation is outputted to the display apparatus 8. More specifically, first, in the γ(G) compensation circuit 5, using an exponential function having a setting value γ(G) as an exponential value, a signal level of brightness $g_1$ of the picture signal $g_1$ is computed from a signal level of brightness $g_0$ of the picture signal $g_0$, so as to produce the picture signal $g_1$ having the signal level of brightness $g_1$. Then, in the inverse property compensation circuit 6, using an inverse function of a function representing the input signal-output brightness of the display apparatus 8, a signal level of brightness $g_{out}$ of a picture signal $g_{out}$ is computed from the signal level of brightness $g_1$ of the picture signal $g_1$, so as to output the picture signal $g_{out}$ having the signal level of brightness $g_{out}$ to the display apparatus 8.

Further, in the maximum output brightness adjustment circuit 3, maximum output brightness of a pixel of the display apparatus 8 is adjusted according to the average input signal level of brightness G. More specifically, an operation is performed on the average input signal level of brightness G so as to obtain maximum output brightness $i_{max}(G)$ of the display apparatus 8, and the operational result is outputted as maximum output brightness $i_{out}$ to the display apparatus 8. The operation of the maximum output brightness $i_{max}(G)$ is, as the curve $i_{max}D$ shown in FIG. 10 for example, performed so that the maximum output brightness $i_{max}(G)$ becomes small as the average input signal level of brightness G increases.

In that case, the signal level of brightness $g_{out}$ of the picture signal $g_{out}$ inputted to a display element of the display apparatus 8 and the maximum output brightness $i_{out}$ can be represented as the following equations (7) and (8):

$$g_{out}=D^{-1}(g_0^{\gamma(G)}) \tag{7}$$

$$i_{out}=i_{max}(G) \tag{8}$$

Further, final output brightness I of the display apparatus 8 can be represented as the following equation (9):

$$I(g_0,G)=i_{out}\cdot D(g_{out})=i_{max}(G)\cdot D\{D^{-1}(g_0^{\gamma(G)})\} \tag{9}$$

Note that, $g_{out}$ represents a normalized input signal level of brightness corresponding to $g_{input}$ of the foregoing equation (6), and $D^{-1}$ ( ) is an inverse function of a function $D(g_{out})$ representing a normalized output level of brightness $g_d$ (corresponding to $g_{output}$ of the foregoing equation (6)) of the display apparatus 8.

Thus, in the image display apparatus according to the present embodiment, setting a gamma value $\gamma(G)$ and maximum output brightness $i_{max}(G)$ with reference to the average input signal level of brightness G of the picture signal $g_0$ subject to inverse gamma compensation as a reference value enables display of an image with high definition capable of superior reproducibility, regardless of a type of the display apparatus 8.

Note that, in the foregoing equations (2) through (9) has been explained processing with respect to a brightness signal of an input picture signal; however, an actual image display apparatus commonly includes processes to convert a brightness signal into a driving voltage $v_1$ for driving a display element, and to convert maximum output brightness $i_{out}$ into a driving voltage $v_2$ of an emission element of the display apparatus 8.

Therefore, equation (9) may also be represented as the following equation (10):

$$I(v_0,V)=i_{max}(V)\cdot D\{D^{-1}(v_0^{\gamma(V)})\} \quad (10).$$

Here, V in equation refers to an average input voltage value of brightness signal voltages.

Further, using linear functions V1 and V2, conversion of the signal level of brightness $g_{out}$ into the driving voltage $v_1$ of the display element of the display apparatus 8, and conversion of the maximum output brightness $i_{out}$ into the driving voltage $v_2$ of the emission element of the display apparatus 8 can be represented as the following equations (11A) and (11B):

$$v_1=V_1(g_{out}) \quad (11A)$$

$$v_2=V_2(i_{out}) \quad (11B).$$

Note that, equations (10), (11A) and (11B) hold when the display apparatus 8 has the form of operation that is driven by a variation in a voltage value; however, the same equations as equations (10), (11A) and (11B) hold even when the display apparatus 8 has the form of operation to be driven by other signals such as signals of heat, light, pressure, oscillation and a sonic wave.

Further, FIG. 1 shows a structure of an image display apparatus in which the display apparatus 8 includes a display element and an emission element which may be controlled separately. In that case, the picture signal $g_{out}$ (signal level of brightness $g_{out}$) obtained from equation (7) and the maximum output brightness $i_{out}$ obtained from equation (8) may be inputted to the display element and the emission element, respectively.

Note that, in case where the display apparatus 8 includes a switching element which functions also as an emission element, that is, a so-called emission type display element (spontaneous light type switching element), it is necessary to adjust the maximum output brightness $i_{out}$ by signal processing of a picture signal.

Consequently, in the inverse property compensation circuit 6, the picture signal $g_1$ prior to the compensation of the property opposite to the input signal-output brightness property of the display apparatus 8 requires to be multiplied by the maximum output brightness $i_{out}$. More specifically, in that case, a signal level of brightness $g_{out}$ of the picture signal $g_{out}$ outputted from the picture signal compensation device 7 can be represented as the following equation (12):

$$g_{out}=D^{-1}(i_{max}(G)\cdot g_0^{\gamma(G)}) \quad (12).$$

Further, the final output brightness I can be represented as the following equation (13). Note that, the representation form of a signal is the same as the foregoing.

$$I(g_0,G)=D(g_{out})=D\{D^{-1}(i_{max}(G)\cdot g_0^{\gamma(G)})\} \quad (13).$$

Here, the processing of a picture signal when inputting the picture signal $g_0$ of an image for television broadcast and the like, that is subject to inverse gamma compensation, has been briefly explained. Therefore, in that case, any particular previous processing was not required; however, for example, in case where a linear picture signal is directly inputted from a device such as a computer which is capable of producing a picture signal, inverse gamma compensation requires to be performed before the foregoing processing.

Further, the foregoing processing of a picture signal may also be performed in the same manner in an analog signal system and a digital signal system; in that case, processing in the digital signal system is more easily performed by an operation of numerical values, and a parameter is more easily changed as well. In case where an analog signal is inputted in the digital signal system, the analog signal requires to be converted into a digital signal before the foregoing processing. The number of bits for gray-scale representation of digital data in this processing should be at least 8 bits or more so as to attain accurate processing; however, when accuracy is not important or a structure is further simplified, the processing may be performed by reducing the number of bits for representation to not more than 8.

For the foregoing processing, the display apparatus 8 may also have an arrangement in which, for example, a switching element and an emission element are separately provided as in a transmissive liquid crystal display device and the like, or an arrangement in which an emission element and a switching element are integrally provided as in the cases of an FED (Field Emission Display) and a PDP, that can be adopted in the same manner, where a quality of display can readily be set.

In the foregoing processing, a gamma value $\gamma(G)$ and maximum output brightness $i_{max}(G)$ which are brightness parameters of an image display apparatus can be set freely. Therefore, when it is arranged that various setting patterns of the gamma value $\gamma(G)$ and the maximum output brightness $i_{max}(G)$ are stored in a memory device, and the storage content can be read out as required, the same image display quality can readily be attained all the time even by a different display apparatus 8.

Further, in the processing of a signal by the picture signal compensation device 7, in case where an input picture signal is made up of a brightness signal $g_0$ and a color difference signal, when a signal level $g_{out}$ of the output signal of brightness $g_{out}$ is $\alpha(0\leqq\alpha\leqq1)$ times greater than the signal level $g_0$ of the input signal of brightness $g_0$, the color difference signal requires to be multiplied by the same coefficient $\alpha$ so as to output the obtained color difference signal.

Further, in the processing of a signal by the picture signal compensation device 7, in case where an input picture signal includes color component signals, and a combination of the color component signals determines the representation of brightness, when the signal level $g_{out}$ of the output signal of brightness $g_{out}$ obtained from the foregoing operation becomes $\beta(0\leqq\beta\leqq1)$ times greater than the signal level $g_0$ of the input signal of brightness $g_0$, a result in which the color component signals are multiplied by $\beta$ may be outputted as output signals.

Further, in the foregoing processing, the processing has been explained based on a linear brightness signal of an inputted picture signal; however, it is also possible to set so that processing is separately performed with respect to each color component signal of the three primary colors of R, G and B, or more primary colors. In that case, it is only required that a signal level of brightness in equations be changed into each color component signal level, thereby performing each processing. When adopting this method, compensation can be made with high accuracy compared to the case where compensation is performed only by a brightness signal, whereas the number of independent parameters increase, thereby increasing a cost of a device such as a memory device for storing parameters and an operation circuit. Therefore, this method may be adopted when an improvement in accuracy is given priority over the cost of a device.

SECOND EMBODIMENT

Figure 2:
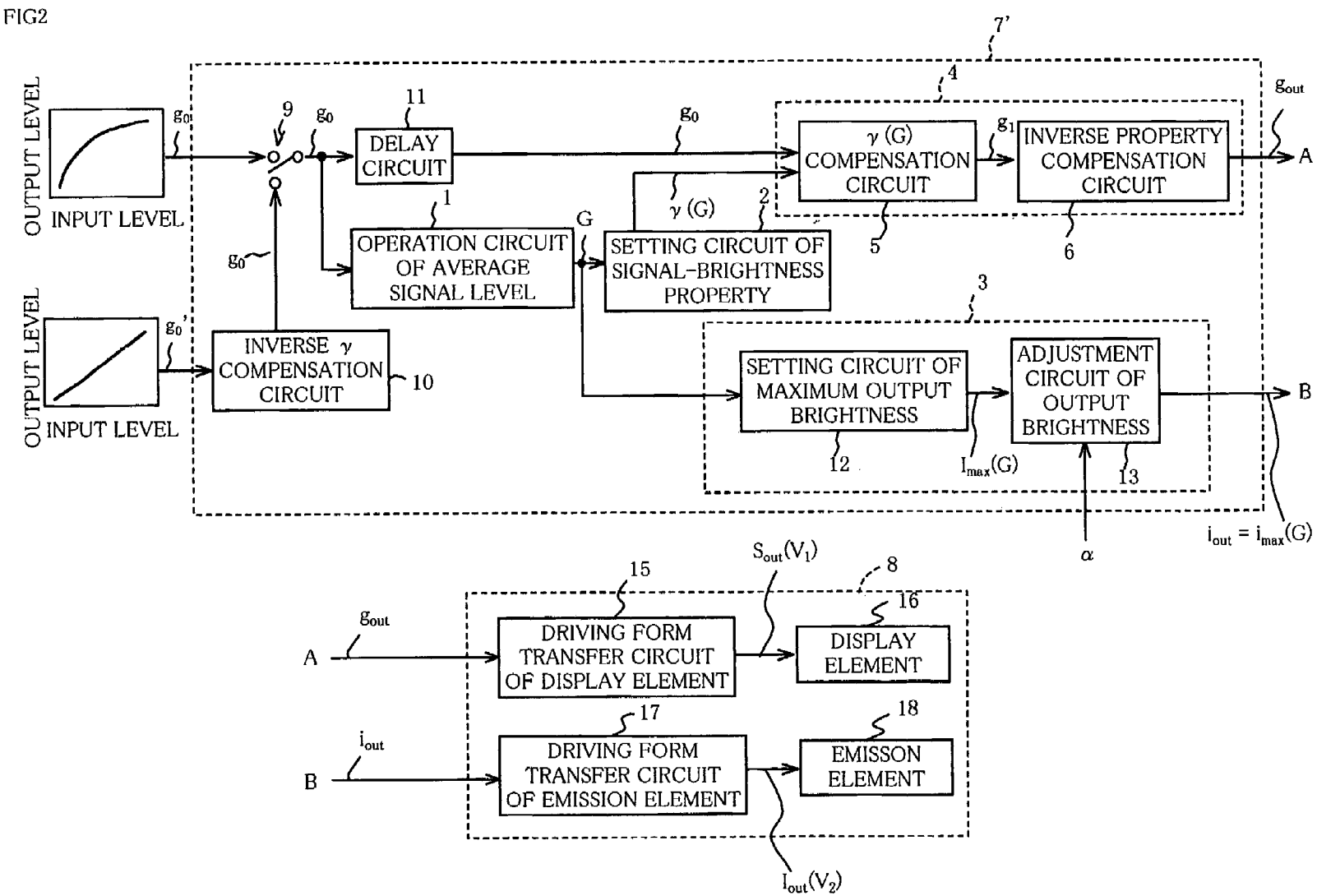
FIG. 2 is a block diagram schematically showing a structure of an image display apparatus to be adopted in an image reproducing method which is a more desirable embodiment of the image reproducing method, the image display apparatus having a display element and an emission element to be controlled separately in a display section.
Figure 3:
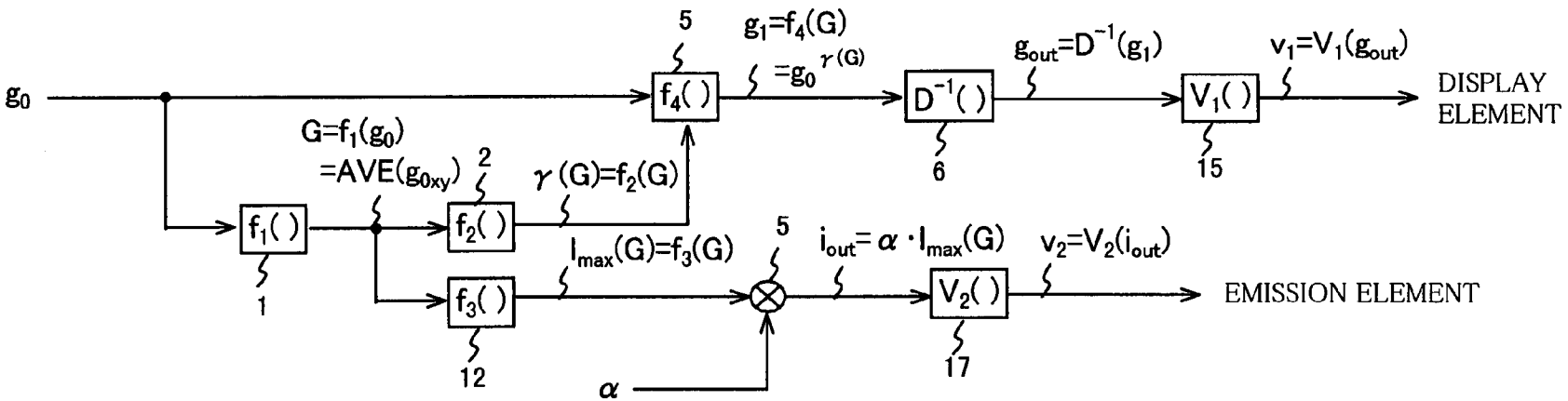
FIG. 3 is a block diagram in schematic form depicting flows of steps in the image reproducing method for the image display apparatus of FIG. 2.

Next, the following will explain a desired example of the embodiment explained in the First Embodiment with reference to FIGS. 2 and 3. Note that, for ease of explanation, members having the same functions as those shown in the drawings pertaining to the First Embodiment above will be given the same reference numerals, and explanation thereof will be omitted here.

An image display apparatus of the present embodiment, as shown in FIG. 2, includes a picture signal compensation device 7' and the display apparatus 8 capable of separately control an emission element and a display element (switching element).

The display apparatus 8 has a non-emission type display element 16, such as a liquid crystal panel including a plurality of pixels, which is not shown, a driving form transfer circuit of display element ("display element driving form transfer circuit", hereinafter) 15, such as a liquid crystal driving circuit for converting a picture signal $g_{out}$ outputted from the picture signal compensation device 7 into a signal (driving signal) $S_{out}$ for driving display, an emission element 18 such as a backlight, a driving form transfer circuit of emission element ("emission element driving form transfer circuit", hereinafter) 17 for converting maximum output brightness $i_{out}$ outputted from the picture signal compensation device 7 into a signal $I_{out}$ having the form in accordance with the input of the emission element 18, and a variable voltage source for generating, for example, a voltage corresponding to maximum output brightness $i_{out}$.

The picture signal compensation device 7' includes, in addition to the average signal level operation circuit 1, input signal-output brightness property setting circuit 2, maximum output brightness adjustment circuit 3 and signal compensation section 4 that are the same as the First Embodiment, a switch 9, an inverse γ compensation circuit 10 and a delay circuit 11.

The switch 9 is to output either of a picture signal $g_0$ from the inverse γ compensation circuit 10 or a picture signal $g_0$ subject to inverse gamma compensation which is inputted from the outside, selectively to both the delay circuit 11 and the average signal level operation circuit 1. In addition, the inverse γ compensation circuit 10 is to perform inverse gamma compensation on a picture signal $g_0$, subject to linear compensation which is inputted from the outside so as to output the picture signal $g_0$ subject to the compensation to the switch 9.

Further, the delay circuit 11, for synchronization of a timing of output of the picture signal $g_0$ to the input signal-output brightness property setting circuit 2 and a timing of output of a gamma value γ(G), which is a setting parameter of the input signal-output brightness property of an image display apparatus, to the signal compensation section 4, delays the picture signal $g_0$ by the time required to perform an operation of the average input signal level of brightness G in the average signal level operation circuit 1 and an operation of the gamma value γ(G) in the input signal-output brightness property setting circuit 2.

The maximum output brightness adjustment circuit 3 of the present embodiment has a setting circuit of maximum output brightness ("maximum output brightness setting circuit", hereinafter) 12 for performing an operation according to the average input signal level of brightness G so as to obtain a setting value $I_{max}$ of the normalized maximum output brightness, and an adjustment circuit of output brightness ("output brightness adjustment circuit", hereinafter) 13 for performing an operation according to the setting value $I_{max}$ of the normalized maximum output brightness and a brightness reference value α given from the outside so as to obtain maximum output brightness $i_{max}$, and outputting a result of the operation to the emission element driving form transfer circuit 17 of the display apparatus 8.

Note that, FIG. 2 shows both the picture signal $g_0$ subject to inverse gamma compensation and the input picture signal $g_0'$ subject to linear compensation, though they are not necessarily be inputted simultaneously. In addition, here, for ease of explanation, a picture signal subject to inverse gamma compensation, and a picture signal subject to inverse gamma compensation performed on the input picture signal $g_0'$ subject to linear compensation will be given the same reference symbol $g_0$, though not intended to refer to the same signal.

Further, an arrangement applicable to both the input of the picture signal $g_0$ subject to inverse gamma compensation and the input of the picture signal (original picture signal) $g_0'$ subject to linear compensation is made in the present embodiment; however, an arrangement which is applicable only to either one of picture signals to be inputted may also be adopted. For example, an arrangement applicable only to the input of the picture signal $g_0$ subject to inverse gamma compensation by excluding the switch 9 and the inverse γ compensation circuit 10.

Next, the following will explain an image reproducing method adopting the foregoing image display apparatus with reference to FIGS. 2 and 3. Note that, here, the signal level of brightness $g_0$, $g_1$, and $g_{out}$, the average input signal level of brightness G, the maximum output brightness (illumination brightness adjustment level) $I_{max}(G)$ and $i_{out}$, and the brightness reference value (external brightness adjustment level) α are all normalized to have a value between 0 to 1.

The picture signal $g_0$ that is inputted to an input terminal (signal input port) of the display apparatus 8 may be the picture signal $g_0'$ subject to linear compensation or the picture signal $g_0$ subject to inverse gamma compensation arranged for a CRT display device. Therefore, first, when inputting the picture signal $g_0'$ subject to linear compensation, inverse gamma compensation is performed in the inverse γ compensation circuit 10. On the other hand, when previously inputting the picture signal $g_0$ subject to inverse gamma compensation, inverse gamma compensation is not performed.

Next, in the average signal level operation circuit 1, an operation is performed on the picture signal $g_0$ subject to inverse gamma compensation, where the average input signal level of brightness G is an average AVE ($g_{0xy}$) ($=f_1(g_0)$) of pixel signal levels of the picture signals of the fixed amount. The picture signals $g_0$ of the fixed amount to be averaged may be either the picture signals $g_0$ of one field of an image, or voltage values of pixel signals sampled at appropriate intervals. Furthermore, in case where the inputted picture signal $g_0$ is a brightness-color difference signal (YPbPr or YCbCr), an operation requires to be performed so as to obtain an average signal level of a brightness signal Y. In addition, in case where the inputted picture signal $g_0$ is a signal of the three primary colors (RGB), an operation may be performed to obtain an average signal level of the signal of the three primary colors (RGB), or an average signal level of the brightness signal Y after converting the signals of the three primary colors (RGB) into the brightness signal Y.

Next, in the input signal-output brightness property setting circuit 2, in accordance with an average input signal level of brightness G is set a gamma value $\gamma(G)$ $(=f_2(G))$ which is an input signal-output brightness property parameter. Further, in the maximum output brightness adjustment circuit 3 is set maximum output brightness $i_{max}(G)$ $(=i_{out})$ corresponding to an average input signal level of brightness G. Specifically, first, in the maximum output brightness setting circuit 12 is performed an operation according to the average input signal level of brightness G so as to obtain an setting value $I_{max}(G)$ of the normalized maximum output brightness. Then, in the output brightness adjustment circuit 13, a setting value $I_{max}$ of the normalized maximum output brightness and an externally given brightness reference value $\alpha$ are multiplied, and the resultant value $\alpha \cdot I_{max}$ is outputted as the maximum output brightness $I_{max}(G)$ to the emission element driving form transfer circuit 17.

Thereafter, in the $\gamma(G)$ compensation circuit 5, employing an exponential function represented by the following equation (14) in which a setting gamma value $\gamma(G)$ is an exponential value, a signal level of brightness $g_1$ of the picture signal $g_1$ is computed from a signal level of brightness $g_0$ of the picture signal $g_0$.

$$f_4(G)=g_0^{\gamma(G)} \tag{14}$$

Here, before supplied to the $\gamma(G)$ compensation circuit 5, the input picture signal $g_0$ is delayed by the time required to perform an operation for an average input signal level of brightness G in the average signal level operation circuit 1 and an operation for a gamma value $\gamma(G)$ in the input signal-output brightness property setting circuit 2, where the input picture signal $g_0$ is arranged to reflect the average input signal level of brightness G of the same time.

Next, in the inverse property compensation circuit 6, employing an inverse function $g_{out}=D^{-1}(g_1)$ of a function representing an input signal-output brightness property of the display apparatus 8, a signal level of brightness $g_{out}$ of the picture signal $g_{out}$ is computed from the signal level of brightness $g_1$ of the picture signal $g_1$, and the resultant picture signal $g_{out}$ having the signal level of brightness $g_{out}$ is outputted to the display device driving form transfer circuit 15.

Thereafter, in the display device driving form transfer circuit 15, the picture signal $g_{out}$ is converted into a signal $S_{out}$ having the input form of the display device 16. Specifically, for example, as shown in FIG. 3, a function $v_1=V_1(g_{out})$ is employed to convert the picture signal $g_{out}$ into a driving voltage level $v_1$ $(=S_{out})$ corresponding to the display device 16. In that case, assuming that a maximum brightness value $g_{out}$ is inputted as data to the display device driving form transfer circuit 15, the data of the maximum brightness value $g_{out}$ is converted into a digital signal having n bits (0 to $2^n-1$) in the display device driving form transfer circuit 15, thereafter converting the digital signal having n bits into the driving voltage level $v_1$ $(=S_{out})$.

Meanwhile, in the emission element driving form transfer circuit 17, a maximum brightness value $i_{out}$ is converted into a signal $I_{out}$ which corresponds to the driving form of the emission element 18. Specifically, for example, as shown in FIG. 3, a function $v_2=V_2(i_{out})$ is employed to convert the maximum brightness value $i_{out}$ into a driving voltage level $v_2$ $(=I_{out})$ corresponding to the display device 16. In that case, assuming that the maximum brightness value $i_{out}$ is inputted as data to the emission element driving form transfer circuit 17, the data of the maximum brightness value $i_{out}$ is converted into a digital signal having n bits (0 to $2^n-1$) in the emission element driving form transfer circuit 17, thereafter converting the digital signal having n bits into the driving voltage level $v_2$ $(=I_{out})$.

In the present embodiment, by thus performing processing of a picture signal, the use of a display apparatus 8 having any brightness property (i.e., an average input signal level of brightness-gamma value property or an average input signal level of brightness-maximum output brightness property), insofar as this is the display apparatus 8 capable of separately controlling the display device 16 and the emission element 18, results in an image display apparatus having an optimum brightness property, thereby realizing display with a high quality.

THIRD EMBODIMENT

Figure 4:
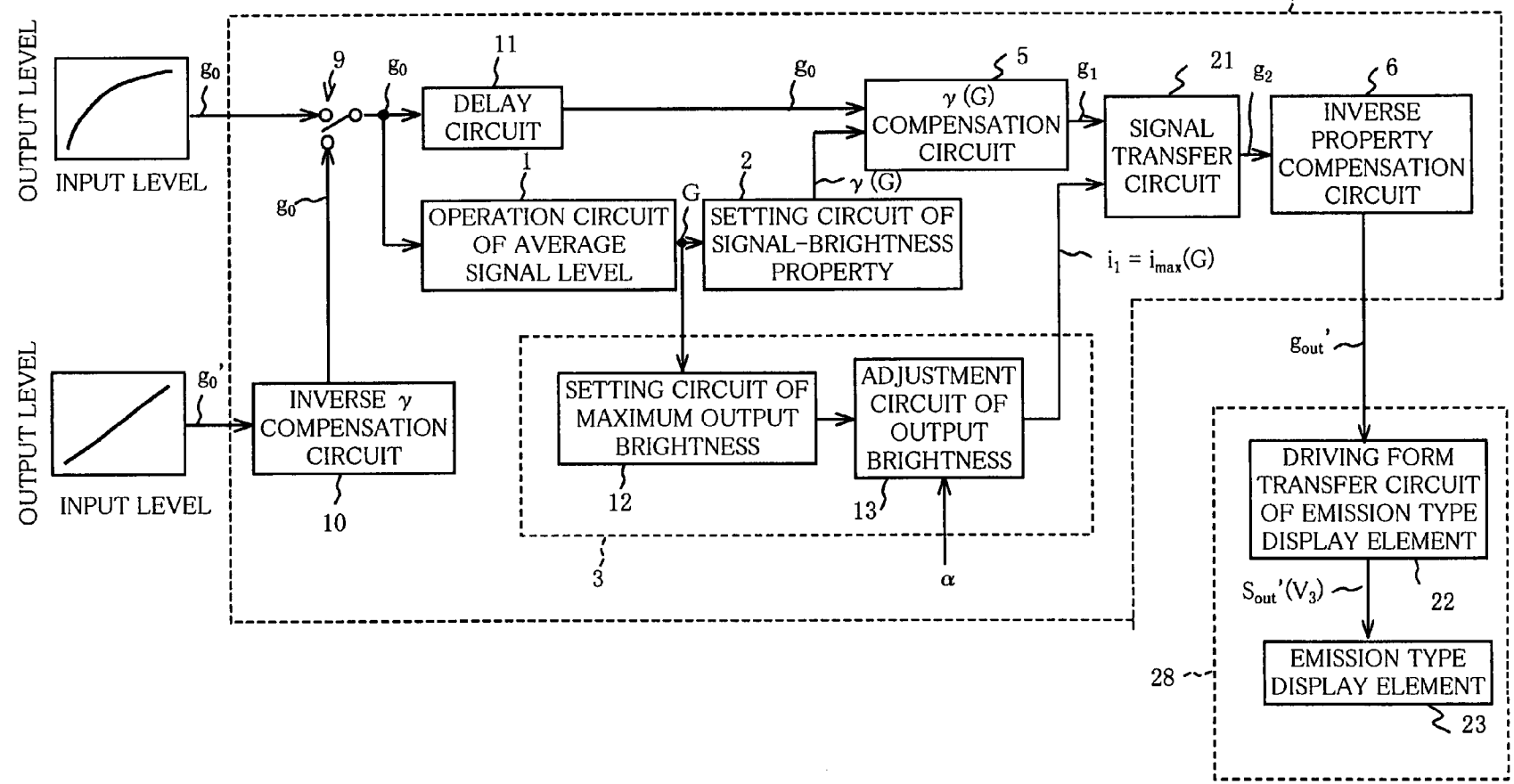
FIG. 4 is a block diagram schematically showing a structure of an image display apparatus to be adopted in an image reproducing method according to another embodiment of the present invention, the image display apparatus having an emission display element in a display section.
Figure 5:
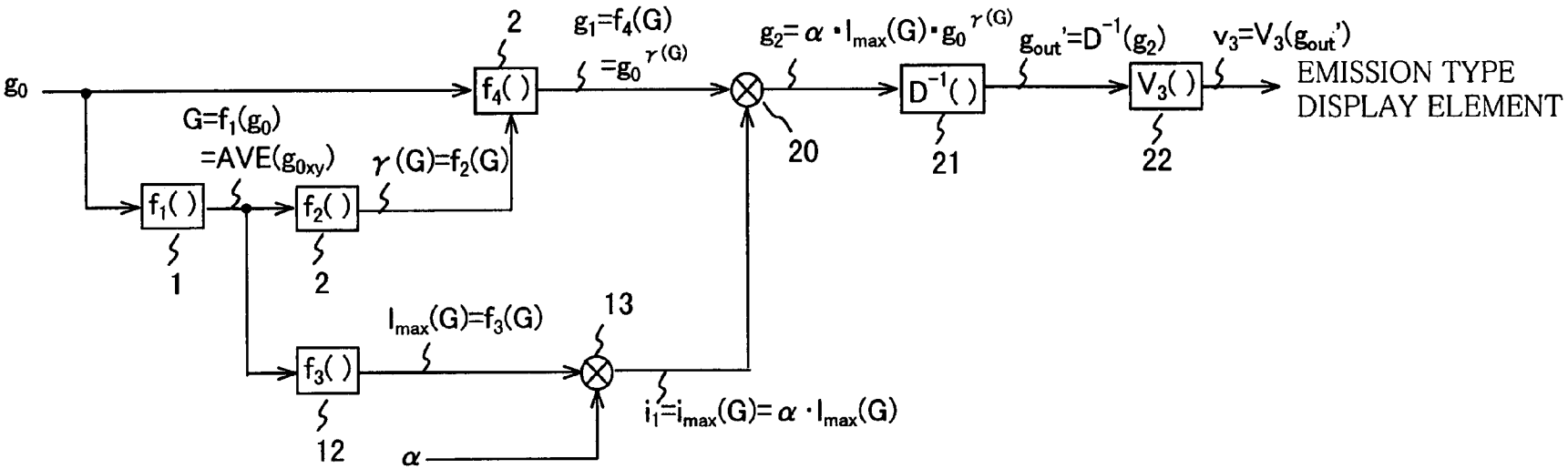
FIG. 5 is a block diagram in schematic form depicting flows of steps in the image reproducing method for the image display apparatus of FIG. 4.

Next, the following will explain another embodiment of the present invention with reference to FIGS. 4 and 5. Note that, for ease of explanation, members having the same functions as those shown in the drawings pertaining to the First and Second Embodiments above will be given the same reference numerals, and explanation thereof will be omitted here.

As shown in FIG. 4, an image display apparatus according to the present embodiment has a picture signal compensation device 27 and a display apparatus 28 in which a display element (switching element) itself functions as an emission element.

The display apparatus 28 includes an emission type display element 23, such as a CRT having a plurality of pixels, which is not shown, a driving form transfer circuit of emission type display element ("emission type display element driving form transfer circuit", hereinafter) 22 for converting a picture signal $g_{out}'$ outputted from a picture signal compensation device 27 into a signal (driving signal) $S_{out}'$ for driving display.

The picture signal compensation device 27 is identical to the picture signal compensation circuit 7 of the Second Embodiment except for an arrangement in which a signal transfer circuit 21 is inserted between the $\gamma(G)$ compensation circuit 5 and inverse property compensation circuit 6 of the Second Embodiment, and an output of the output brightness adjustment circuit 13 is supplied to the signal transfer circuit 21.

The signal transfer circuit 21 multiplies a signal level $g_1$ of the picture signal $g_1$ from the $\gamma(G)$ compensation circuit 5 by maximum output brightness $i_1$ $(=i_{max}(G)=\alpha \cdot I_{max}(G))$ so as to output the resultant picture signal $g_2$ to the inverse property compensation circuit 6.

Next, the following will describe an image reproducing method adopting the foregoing image display apparatus with reference to FIGS. 4 and 5. Note that, here, signal levels of brightness $g_0$, $g_1$, $g_2$ and $g_{out}'$, an average signal level of brightness G, maximum output brightness (illumination brightness adjustment levels) $I_{max}(G)$ and $i_1$, and a brightness reference value (external brightness adjustment level) $\alpha$ are all normalized so as to have a value ranging from 0 to 1.

First, processes to compute appropriate maximum output brightness $i_1$ ($=i_{max}(G)$) and a gamma value $\gamma(G)$ from the input picture signal $g_0$, and to compensate the input picture signal $g_0$ to be the picture signal $g_1$ in the $\gamma(G)$ compensation circuit 5 are identical to the Second Embodiment.

Note that, in the maximum output brightness adjustment circuit 3, the maximum output brightness $i_{max}(G)$ is changed in accordance with an average input signal level of brightness G, where the maximum output brightness level available to be outputted in the display apparatus 28 is 100%, that has been preset in the image display apparatus.

Here, when $Y_{100}$ is the maximum output brightness level available to be outputted in the display apparatus 28, and $\alpha$ is a ratio of the maximum output brightness $i_{max}(G)$ for an input image at the average input signal level of brightness G to $Y_{100}$, the following equation holds:

$$\alpha=I_{max}(G)/Y_{100} \quad (15).$$

Here, the following equation is given to be set:

$$Y_{100}=I_{max}(G_{100}) \quad (16)$$

In the image reproducing method of the present embodiment, to follow these processes above, in the signal conversion circuit 21, the signal level $g_1$ of the picture signal $g_1$ from the $\gamma(G)$ compensation circuit 5 is multiplied by the maximum output brightness $i_1$ ($=I_{max}(G)$). Namely, the picture signal $g_1$ is multiplied by the maximum output brightness $i_1$, then, the picture signal $g_2$ is obtained by the following equation:

$$g_2=i_1 \cdot g_1 \quad (17).$$

The signal is thus converted by multiplying the picture signal (brightness signal) $g_1$ by the maximum output brightness $i_1$, in order that the maximum output brightness of the display apparatus 28 depends on the input signal level of the emission type display device 23.

Thereafter, the obtained picture signal $g_2$ is outputted to the inverse property compensation circuit 6 where, using an inverse function $g_{out}'=D^{-1}(g_2)$ of a function representing the input signal-output brightness property of the display apparatus 28, a signal level of brightness $g_{out}'$ of the picture signal $g_{out}'$ is computed from a signal level of brightness $g_2$ of the picture signal $g_2$.

Further, the picture signal $g_{out}'$ having the signal level of brightness $g_{out}'$ is outputted to the emission type display element driving form transfer circuit 22 so as to be converted into a signal $S_{out}'$ having the input form corresponding to the display apparatus 28 therein. More specifically, for example, as shown in FIG. 5, a function $v_3=V_3(g_{out}')$ is used to convert the picture signal $g_{out}'$ to have a driving voltage level $v_3(=S_{out}')$ corresponding to the emission type display element 23. In that case, assuming that maximum brightness value $g_{out}'$ as data is inputted to the emission type display element driving form transfer circuit 22, the data of the maximum brightness value $g_{out}'$ is converted into a digital signal of n bits (0 to $2^n-1$), say, a digital signal of 8 bits (0 to 255) in the emission type display element driving form transfer circuit 22, thereafter converting the digital signal of n bits into the driving voltage level $v_3$ ($=S_{out}'$).

In the present embodiment, by thus performing the processing of a picture signal, the use of the display apparatus 28 including an emission display element having any brightness property (i.e., an average input signal level of brightness—-a gamma value property or an average input signal level of brightness-maximum output brightness property) results in an image display apparatus having an optimum brightness property, thereby realizing display with a high quality.

Note that, through the foregoing embodiments have been obtained display with a high quality by adjusting both the input signal-output brightness property of the image display apparatus and the maximum output brightness of a pixel in a display section in accordance with an average input signal level of brightness; however, it is also possible to attain display of a certain degree of quality when adjusting only either the input signal-output brightness property of the image display apparatus or the maximum output brightness of a pixel in the display section in accordance with an average input signal level of brightness.

As described, the image reproducing method according to the present invention is the method for reproducing an image by a display apparatus having a plurality of pixels based on a picture signal including a pixel signal representing information of each pixel, includes the steps of: performing an operation to obtain an average signal level which is an average level of all the pixel signals, then, setting an input signal-output brightness property which represents variations in brightness of a pixel with respect to the level of a pixel signal in accordance with the average signal level; and reproducing an image so as to satisfy the input signal-output brightness property thus set.

In this method, for example, when using a display apparatus (liquid crystal display device, etc.) having a constant input signal-output brightness property regardless of an average signal level, it is possible to reduce an exponential value (gamma value) in which the input signal-output brightness property is approximately represented by an exponential function, according to an increase in the average signal level, thereby reproducing an image which is superior in terms of visibility in a dark portion of an entirely dark image (image having low average brightness), and also superior in terms of visibility in a bright portion by preventing whiteout and glare caused by an entirely bright image (image having high average brightness). Consequently, by the foregoing method, regardless of whether or not the input signal-output brightness property varies as an average signal level varies, an image of superior quality can be reproduced.

Further, a preferable embodiment of the image reproducing method includes the step of reproducing an image so that maximum output brightness of a pixel of the display apparatus varies according to the average signal level.

In this method, for example, when using a display apparatus (liquid crystal display device, etc.) which has constant maximum output brightness regardless of an input average signal level, as an average signal level of an image display apparatus increases, maximum output brightness of the display apparatus can be reduced, thereby reducing glare caused by a screen when reproducing an entirely bright image while preventing temporary blindness due to a retinal bleaching phenomenon when directly viewing the screen. Consequently, by the foregoing method, regardless of a type of the display apparatus can be reproduced an image with a high display quality.

Further, as discussed, the image reproducing method of the present invention reproduces an image by a display apparatus having a plurality of pixels based on a picture signal including a pixel signal representing information of each pixel, wherein an operation is performed to obtain an average signal level which is an average level of all the pixel signals, thereafter reproducing an image so that maximum output brightness of a pixel of the display apparatus varies according to the average signal level.

In this method, for example, even when adopting a display apparatus (liquid crystal display device, etc.) having constant maximum output brightness regardless of an input average signal level, maximum output brightness of the display apparatus can be reduced in accordance with an increase in the average signal level of an image display apparatus, thereby reducing glare caused by a screen when reproducing an entirely bright image while preventing temporary blindness due to a retinal bleaching phenomenon when directly viewing the screen. Consequently, by the foregoing method, regardless of an average signal level-maximum output brightness property of the display apparatus can be reproduced an image with a high display quality.

Note that, a maximum output brightness value and/or an input signal-output brightness property can arbitrarily be set according to an average signal level in the foregoing image reproducing methods.

It is preferable that the average signal level be obtained by performing an operation to obtain an average level of all the pixel signals within a unit period of time. The unit period of time may be an entire period of time to form an image of one frame, for example; alternatively, it may be part of a period of time to form an image such as a period of time covering one field or more. In addition, the average signal level may also be obtained by carrying out sampling of instantaneous voltage levels of all the pixel signals in an appropriate sampling cycle, and performing an operation to obtain an average voltage level of the sampled voltage levels.

In the foregoing image reproducing method, it is preferable that an image is reproduced so that an exponential value in which the input signal-output brightness property is approximately represented by an exponential function becomes larger as the average signal level increases, thereby reducing glare caused by a screen when reproducing an entirely bright image (image having high average brightness) while preventing temporary blindness due to a retinal bleaching phenomenon when directing viewing the screen. Consequently, by the foregoing method can be reproduced the entirely bright image as an image having superior visibility.

Further, in the foregoing image reproducing methods, it is preferable that an image be reproduced so that maximum output brightness becomes smaller as the average signal level increases, thereby improving visibility in a dark portion of an entirely dark image (image having low average brightness) while preventing whiteout and glare caused by an entirely bright image (image having high average brightness), thus improving visibility in a bright portion. Consequently, both the entirely dark image and entirely bright image can be reproduced as an image having superior visibility.

Further, as discussed, the image display apparatus of the present invention which has a display section having a plurality of pixels to display an image and receives a picture signal including a pixel signal representing information of each pixel, includes: an average signal level operation section for performing an operation to obtain an average signal level which is an average level of all the pixel signals; an input signal-output brightness property setting section for setting an input signal-output brightness property which represents variations in brightness of a pixel with respect to a level of the pixel signal in accordance with the average signal level; and a signal compensation section for performing compensation of a picture signal so as to satisfy the input signal-output brightness property thus set.

With this arrangement, the input signal-output brightness property can be varied in accordance with the average signal level, and therefore, for example, when adopting a display section (liquid crystal display device, etc.) having a constant input signal-output brightness property regardless of the average signal level, it is possible to attain an image display apparatus having such a property that an exponential value (gamma exponent in the case of a CRT display device) in which a non-linear function of the input signal-output brightness property is approximately represented by an exponential function increases as the average signal level increases, thereby providing an image display apparatus having superior visibility in a dark portion of an entirely dark image (image having low average brightness) and in a bright portion of an entirely bright image (image having high average brightness). Consequently, with the foregoing arrangement, regardless of whether or not the input signal-output brightness property of the display section varies according to the average signal level can be provided an image display apparatus capable of displaying an image with a high display quality.

Further, an preferable embodiment of the image display apparatus further includes a maximum output brightness adjustment section for adjusting maximum output brightness of a pixel of the display section in accordance with the average signal level.

With this arrangement, maximum output brightness of a pixel of the display section can be adjusted according to the average signal level, and therefore, for example, when adopting a display section (liquid crystal display device, etc.) having constant maximum output brightness regardless of the average signal level, an image display apparatus having such a property that maximum output brightness becomes smaller as the average signal level increases can be attained. Consequently, when inputting a picture signal having high average signal level, glare caused by a screen can be greatly reduced, while preventing temporary blindness due to a retinal bleaching phenomenon when directly viewing the screen, thus providing an image display apparatus having superior visibility in an entirely bright image. Namely, with the foregoing arrangement, by allowing both the input signal-output brightness property and the maximum output brightness of the display section to vary in accordance with the average signal level of the picture signal, regardless of a type of the display section can be provided an image display apparatus capable of displaying an image with a high display quality.

Further, as discussed, the image display apparatus of the present invention which includes a display section having a plurality of pixels for displaying an image and receives a picture signal including a pixel signal representing information of each pixel, includes: an average signal level operation section for performing an operation to obtain an average signal level which is an average level of all the pixel signals; and a maximum output brightness adjustment section for adjusting maximum output brightness of a pixel of a display section in accordance with the average signal level.

With the foregoing arrangement, maximum output brightness of a pixel of the display section can be adjusted according to the average signal level, and therefore, for example, even when adopting a display section (liquid crystal display device, etc.) having constant maximum output brightness regardless of the average signal level, an image display apparatus having such a property that maximum output brightness becomes smaller as the average signal level increases can be attained. Consequently, when inputting a picture signal having a high average signal level, glare caused by a screen can be greatly reduced, while preventing temporary blindness due to a retinal bleaching phenomenon when directly viewing the screen, thus providing an image display apparatus having superior visibility in an entirely bright image. Consequently, with the foregoing arrangement, regardless of an average signal level-maximum output brightness property of the display section can be provided an image display apparatus capable of displaying an image with a high display quality.

In the image display apparatuses having the different arrangements as above, a maximum output brightness value and/or an input signal-output brightness property can arbitrarily be set according to an average signal level. Therefore, when focusing only this part of the image display apparatus having either of the foregoing arrangements, it is effective in an evaluation of a display quality of various forms of display apparatuses, and an evaluation in the case of applying a high-quality image reproducing parameter to an existing display apparatus.

More specifically, as discussed, the picture signal compensation device of the present invention which receives a picture signal including a pixel signal representing information of each pixel and performs compensation of the picture signal so as to output the picture signal subject to compensation to a display section having a plurality of pixels, includes: an average signal level operation section for performing an operation to obtain an average signal level which is an average level of all the pixel signals; an input signal-output brightness property setting section for setting an input signal-output brightness property which represents variations in brightness of a pixel with respect to a level of the pixel signal in accordance with the average signal level; and a signal compensation section for performing compensation of a picture signal so as to satisfy the input signal-output brightness property thus set.

With the foregoing arrangement, since the input signal-display apparatus output brightness property of the picture signal compensation device can be varied in accordance with the average signal level, when adopting, for example, a display apparatus (liquid crystal display device, etc.) having a constant input signal-output brightness property regardless of the average signal level, an image having superior visibility in a dark portion of an entirely dark image (image having low average brightness) and in a bright portion of an entirely bright image (image having high average brightness) can be displayed. Consequently, with the foregoing arrangement, regardless of whether or not the input signal-output brightness property of the display apparatus varies in accordance with the average signal level can be provided a picture signal compensation device capable of display an image with a high display quality.

Further, a preferable embodiment of the picture signal compensation device further includes a maximum output brightness adjustment section for performing compensation of a picture signal so that maximum output brightness of a pixel of the display apparatus varies in accordance with the average signal level.

With this arrangement, since the maximum output brightness of a pixel of the display apparatus can be adjusted according to the average signal level, when adopting, for example, a display apparatus such as a liquid crystal display device having constant maximum output brightness regardless of the average signal level, such display that maximum output brightness becomes smaller as the average signal level increases can be attained. Therefore, when inputting a picture signal having a high average signal level, glare caused by a screen can be greatly reduced, while preventing temporary blindness due to a retinal bleaching phenomenon when directly viewing the screen, thereby improving visibility in an entirely bright image. Namely, with the foregoing arrangement, by allowing both the input signal-output brightness property and the maximum output brightness of the display section to vary according to the average signal level of the picture signal, regardless of a type of the display apparatus can be provided a picture signal compensation device capable of display an image with a high display quality.

Further, as discussed, the picture signal compensation device of the present invention which receives a picture signal including a pixel signal representing information of each pixel, and performs compensation of the picture signal so as to output the picture signal subject to compensation to a display apparatus having a plurality of pixels, includes: an average signal level operation section for performing an operation to obtain an average signal level which is an average level of all the pixel signals; and a maximum output brightness adjustment section for performing compensation of the picture signal so that maximum output brightness of a pixel of the display apparatus varies in accordance with the average signal level.

With the foregoing arrangement, since maximum output brightness of a pixel of the display apparatus can be adjusted in accordance with the average signal level, when adopting, for example, a display apparatus (liquid crystal display device, etc.) having constant maximum output brightness regardless of the average signal level, such display that maximum output brightness becomes smaller as the average signal level increases can be attained. Therefore, when inputting a picture signal having a high average signal level, glare caused by a screen can greatly be reduced, while preventing temporary blindness due to a retinal bleaching phenomenon when directing viewing the screen, thus improving visibility in an entirely bright image. Consequently, with the foregoing arrangement, regardless of the average signal level-maximum output brightness property of the display apparatus can be provided a picture signal compensation device capable of displaying an image with a high display quality.

It is preferable that the average signal level operation section performs an operation to obtain an average level of all the pixel signals within a unit period of time. The unit period of time may be an entire period of time to form an image of one frame, for example; alternatively, it may be part of a period of time to form an image such as a period of time covering one field or more. In addition, the average signal level operation section may have an arrangement in which sampling of instantaneous voltage levels of all the pixel signals is carried out in an appropriate sampling cycle, and an operation to obtain an average voltage level of the sampled voltage levels is performed.

It is preferable that the maximum output brightness adjustment section adjusts maximum output brightness so as to be smaller as the average signal level increases, thereby, when inputting a picture signal having a high average signal level, greatly reducing glare caused by a screen while preventing temporary blindness due to a retinal bleaching phenomenon when directly viewing the screen thus improving visibility in an entirely bright image.

Further, it is preferable that the input signal-output brightness property setting section sets an exponential value (gamma value in the case of a CRT display device) in which the input signal-output brightness property is approximately represented by an exponential function, so as to be larger as the average signal level increases, thereby improving visibility in a dark portion of an entirely dark image (image having low average brightness) and in a bright portion of an entirely bright image (image having high average brightness).

Furthermore, it is more preferable that the maximum output brightness adjustment section adjusts maximum output brightness to be smaller as the average signal level increases, and the input signal-output brightness property setting section sets an exponential value (gamma value in the case of a CRT display device) in which the input signal-output brightness property is approximately represented by an exponential function so as to be larger as the average signal level increases, thereby greatly improving visibility in a bright portion of an entirely bright image (image having high average brightness) and in a dark portion of an entirely dark image (image having low average brightness).

The picture signal inputted in the image display apparatus and picture signal compensation device having the foregoing arrangements, that is, the picture signal to be adopted in reproducing an image by the image reproducing methods of the present invention may be either one of a monochromatic video signal having a brightness signal which represents brightness information of each pixel, a color video signal including a brightness signal which represents brightness information of each pixel and a chromaticity signal which represents chromaticity information of each pixel, and a color video signal including a color component signal of three or more primary colors.

When the picture signal to be inputted includes a brightness signal representing brightness information of each pixel, it is preferable that the average signal level operation section performs an operation to obtain an average signal level which is an average level of all the brightness signals, thereby simplifying a configuration of a device and reproducing an image in an image display apparatus having the simple configuration.

More specifically, in a standard image display apparatus, as a picture signal is inputted a color video signal made up of a brightness signal and a color difference signal. In that case, among all the signals composing the color video signal, it is the brightness signal that has an effect on the input signal-output brightness property and maximum output brightness of the display section. Therefore, when performing an operation to obtain an average signal level of the brightness signal alone, rather than performing an operation to obtain an average signal level of each of the brightness and color difference signals in the average signal level operation section, the number of signals to be processed is greatly reduced, thereby making it possible to simplify the configuration of a device and reproduce an image in an image display apparatus having the simple configuration.

Further, when an input picture signal is a color video signal including a color component signal of three primary colors (for example, RGB) or more primary colors, the average signal level is preferably obtained by performing an operation to obtain from the color component signal an average level having a value corresponding to a brightness value. Therefore, it is preferable that the average signal level operation section performs an operation to obtain from the color component signal an average level having a value corresponding to a brightness value. An operation method for an average level having the value corresponding to the brightness value may be selected from a method of computing values corresponding to brightness from the color component signals of all the colors by a conversion equation, and thereafter averaging the resultant values, and a method of averaging values of the color component signals of all the colors, and thereafter converting the resultant average value into an average value corresponding brightness by a conversion equation. Further, as an operation method for an average level of the brightness signal may be adopted an operation method for obtaining an average signal level by a color component signal of a partial color, but not by the color component signals of all the colors. In that case, as in the case of using components of color component signals of all the colors above, the sequence of conversion into a value corresponding to brightness and an operation for an average value is arbitrary.

Further, when inputting a color video signal including such color component signals, the average signal level operation section may not be arranged to compute an average level having a value corresponding to a brightness value, but may be arranged to perform an operation to obtain an average signal level which is an average level of at least one of all the color component signals. More specifically, for example, when inputting a signal of the three primary colors of RGB as a picture signal, computation may be performed by picking up only a G signal so as to have an average value of the levels of the G signal as an average signal level; alternatively, an average value of the levels of each color component signal may be computed as an average signal level.

Further, it is preferable that, when the picture signal to be inputted includes a brightness signal representing brightness information of each pixel, the foregoing image reproducing method has an arrangement in which an input signal of brightness-output brightness property, which represents variations in brightness in a pixel with respect to a level of the brightness signal, is set according to the average signal level, and compensation is performed on the brightness signal so as to satisfy the input signal of brightness-output brightness property thus set.

Accordingly, when the picture signal to be inputted includes a brightness signal representing brightness information of each pixel, it is preferable that the input signal of brightness-output brightness property setting section sets the input signal of brightness-output brightness property representing variations in brightness of a pixel with respect to a level of the brightness signal in accordance with the average signal level, and the signal compensation section performs compensation of the brightness signal so as to satisfy the input signal of brightness-output brightness property thus set.

Further, when the picture signal to be inputted includes color component signals of the three primary colors (for example, RGB) or more primary colors, it is preferable that the image reproducing method has an arrangement in which the input signal-output brightness property, which represents variations in brightness of a pixel with respect to a level of at least one of all the color component signals, is set in accordance with the average signal level, and compensation is performed on at least one of the color component signals so as to satisfy the input signal-output brightness property thus set.

More specifically, when the picture signal to be inputted includes color component signals of the three primary colors (for example, RGB) or more primary colors, it is preferable that the input signal-output brightness property setting section sets an input signal-output brightness property representing variations in brightness of a pixel with respect to a level of at least one of all the color component signals is set according to the average signal level, and the signal compensation section performs compensation on at least one of all the color component signals so as to satisfy the input signal-output brightness property thus set.

In the image display apparatus and the picture signal compensation device having a signal compensation section preferably includes a delay section which delays output of a pixel signal of the inputted picture signal to the signal compensation section by the time required to perform an operation to obtain an average signal level and to set an input signal-output brightness property.

When transmitting the inputted picture signal as it is to the signal compensation section, compensation cannot be performed on the picture signal until an average signal level corresponding to its pixel signal is computed and an input signal-output brightness property is set. In that case, therefore, the inputted picture signal cannot be processed successively, thereby failing to display an input image in the display section (display device) in real time.

In contrast, as discussed, when there is provided the delay section for delaying the inputted picture signal by the time required to perform an operation to obtain an average signal level and to set an input signal-output brightness property, it is possible to synchronize the timing of output of the picture signal to the signal compensation section and the timing of output of the input signal-output brightness property that was set by the input signal-output brightness property setting section to the signal compensation section, thereby making it possible to display (reproduce and output) an input signal in the display section (display device) in real time.

The delay section is required to temporarily save the pixel signal of the inputted picture signal. Therefore, the delay section is preferably a storage means capable of temporary storage of image data, such as a RAM (Random Access Memory).

Further, when setting an input signal-output brightness property, there may be performed an operation to obtain from an average signal level a parameter representing an input signal-output brightness property by equation. Alternatively, the input signal-output brightness property may be set by storing a lookup table which correlates an average signal level with an input signal-output brightness property in a storage device such as a memory, for reference in the setting.

More specifically, the input signal-output brightness property setting section may have an arrangement in which equation is employed in the operation to obtain from an average signal level a parameter which represents an input signal-output brightness property. Alternatively, the input signal-output brightness property setting section may have an arrangement in which a lookup table which correlates an average signal level with an input signal-output brightness property in a storage device such as a memory, for reference in the setting.

The lookup table may be created based on results of measurement obtained from measurement of various input signal-output brightness properties previously performed.

Further, when performing compensation of a picture signal by operational processing employing an input signal-output brightness property parameter, it is preferable that a pixel signal is converted according to an I/O property corresponding to an input signal-output brightness property by the operational processing employing the input signal-output brightness property parameter, thereafter performing compensation for deviation from a linear property of the input signal-output brightness property of the display section (display device).

Accordingly, when the signal compensation section performs operational processing employing the input signal-output brightness property parameter, the signal compensation section preferably includes a first signal compensation section for converting a pixel signal according to an I/O property corresponding to the input signal-output brightness property by the operational processing employing the input signal-output brightness property parameter, and a second signal compensation section for performing compensation for deviation from a linear property of the input signal-output brightness property of the display section (display device).

With the foregoing arrangement, as a result of compensation in the second signal compensation section, an input signal-output brightness property of a combination of the second signal compensation section and the display section (that is, a combination of an I/O property of the second compensation and the input signal-output brightness property of the display device) becomes a linear property. Therefore, the first signal compensation section which performs the first compensation may only perform simple operational processing employing the input signal-output brightness property parameter alone, thereby simplifying the configuration of the operation section while simplifying an operation for the first compensation.

In contrast, when having no second signal compensation section, namely, when not performing the second compensation, it is required that compensation of a picture signal be performed by employing both the input signal-output brightness property parameter and the input signal-output brightness property parameter of the display section, thereby complicating the configuration of the operation section while complicating an operation.

Note that, at the second compensation, that is, in the second signal compensation section, it may be arranged that a pixel signal is converted by an inverse function of a function representing the input signal-output brightness property of the display section (display device). It should be noted here that, when performing display by a plurality of different types of display sections (display devices), since the type of display sections (display devices) is not specified, the input signal-output brightness property of the display section (display device) may possibly vary into various properties. Therefore, in that case, it is preferable that the input signal-output brightness properties of the various types of display sections (display devices) are previously correlated with the type of the display section (display device) so as to store them in either a storage device such as a RAM or a storage medium such as a hard disc, then, the second signal compensation section refers to the storage contents so as to perform compensation of the picture signal according to an I/O property which is an inverse property of the input signal-output brightness property of the display section (display device).

The display section (display device) may have an emission element and an optical switching element for controlling light from the emission element for each pixel. Accordingly, the display section (display device) may be made up of an emission type optical switching element (emission type display element) which functions as the emission element as well, such as a CRT, a light emitting diode, a plasma display panel (PDP), and an FED (Field Emission Display); alternatively, it may be made up of an emission element and a non-emission type optical switching element (non-emission type display element), the optical switching element for controlling or modulating light from the emission element without emitting light itself, such as a liquid crystal display element.

When, as in the case of a transmissive liquid crystal display device, the display section (display device) includes an emission element and a non-emission type optical switching element, which can separately be controlled, it is preferable that the maximum output brightness adjustment section performs an operation to obtain maximum output brightness and outputs the operational result to the emission element. In addition, the maximum output brightness is preferably obtained by performing an operation for normalized maximum output brightness, thereafter performing an operation for maximum output brightness based on the operational result and an externally given brightness reference value.

Meanwhile, when the display section (display device) includes an emission element which functions as an optical switching element as well, i.e., an emission type optical switching element, it is preferable that an operation is performed to obtain maximum output brightness according to operational results while converting a picture signal subject to compensation in accordance with the input signal-output brightness property thus set, so as to output the picture signal subject to conversion to the emission type optical switching element. Accordingly, when the display section (display device) includes the emission element which functions as an optical switching element as well, i.e., an emission type optical switching element, it is preferable that the maximum output brightness adjustment section is arranged to perform an operation for maximum output brightness, and that the maximum output brightness adjustment section further includes a signal conversion section for converting a picture signal subject to compensation in the signal compensation section based on the operational result of the maximum output brightness, so as to output the picture signal subject to compensation to the emission type optical switching element.

It is preferable that the foregoing operations processes are carried out by a circuit, that is, hardware, but may also be carried out by software. More specifically, it is preferable that sections to perform operations in the foregoing arrangements (the average signal level operation section, the input signal-output brightness property setting section, the signal compensation section and the maximum output brightness adjustment section) are provided by circuits as hardware, but may also be provided as software.

Namely, the foregoing operational processes may be carried out by storage means such as a RAM which stores a computer program describing an operational process of each operation section, and a CPU (Central Processing Unit) which carries out the computer program, and the sections to perform an operation in the foregoing arrangements may be provided as the storage means such as the RAM which stores a computer program describing an operational process of each operation section, and the CPU (Central Processing Unit) which carries out the computer program.

The following will describe the present invention further in detail by giving examples, though the present invention is not limited thereby.

EXAMPLE 1

First, a commercially available HDTV (high-definition television) which was a high-definition CRT display device was used to measure a relation among an average input signal level of brightness (an average value of input signals of brightness all over the screen), input signal of brightness data and maximum output brightness.

In the measurement was used a frame image of the size of 1920×1035 pixels in the center of which an image having a box of the size of 150×150 pixels was provided, then, an input signal level of brightness B (a relative value whose maximum value was 100%) in the box, and an input signal level of brightness H (a relative value whose maximum value was 100%) in a background (a portion other than the box) were allowed to vary, so as to measure output brightness in the box by a color and brightness meter. In addition, linear data were used as an input signal of brightness.

As a result of measurement, output brightness in each box when fixing the input signal level of brightness H in the background and allowing the input signal level of brightness B to vary was the one shown in FIG. 8. In addition, FIG. 9 shows the plot of the output brightness in the box with respect to an average input signal level of brightness G on a screen where the input signal level of brightness H in the background was constant.

In that case, the box had an area which is 1.13% of the area of the whole screen, that was small enough. Therefore, the input signal level of brightness H in the background may be regarded as being equivalent to the average input signal level of brightness G of the whole image.

Accordingly, in the present Example, in the arrangement of the First Embodiment, in order to perform the same display (reproduction) as the display property of a CRT display device D (or E), setting parameters, that is, setting values of maximum output brightness $i_{max}(G)$ and a gamma value $\gamma(G)$ were varied as curves $i_{max}D$ (or $i_{max}E$) and $\gamma D$ (or $\gamma E$) show in FIG. 10, in correspondence with the average input signal level of brightness G, thereby realizing an image display apparatus by adopting a display apparatus except the CRT display device, for example, a liquid crystal display, which has an average input signal level of brightness-maximum output brightness property (variation in maximum output brightness $i_{max}(G)$ with respect to the average input signal level of brightness G) and an average input signal level of brightness-gamma value property (variation in the gamma value $\gamma(G)$ with respect to the average input signal level of brightness G) as with the CRT display device D (or E).

Then, in this image display apparatus, based on results shown in FIGS. 8 to 10, when an average input signal level of brightness G is low, a gamma value $\gamma(G)$ is increased, and output brightness in a dark portion is increased relative to the increase in the gamma value $\gamma(G)$, thereby expecting an improvement in visibility in the dark portion. On the other hand, when an average signal level of brightness G is high, a gamma value $\gamma(G)$ is decreased, and output brightness in a bright portion is decreased relative to the decrease in the gamma value $\gamma(G)$, thereby greatly expecting an improvement in visibility in a bright portion. Further, when an average signal level of brightness G is high, maximum output brightness $i_{max}(G)$ is decreased so as to suppress glare of a screen, thereby expecting an increase in visibility.

Figure 11:
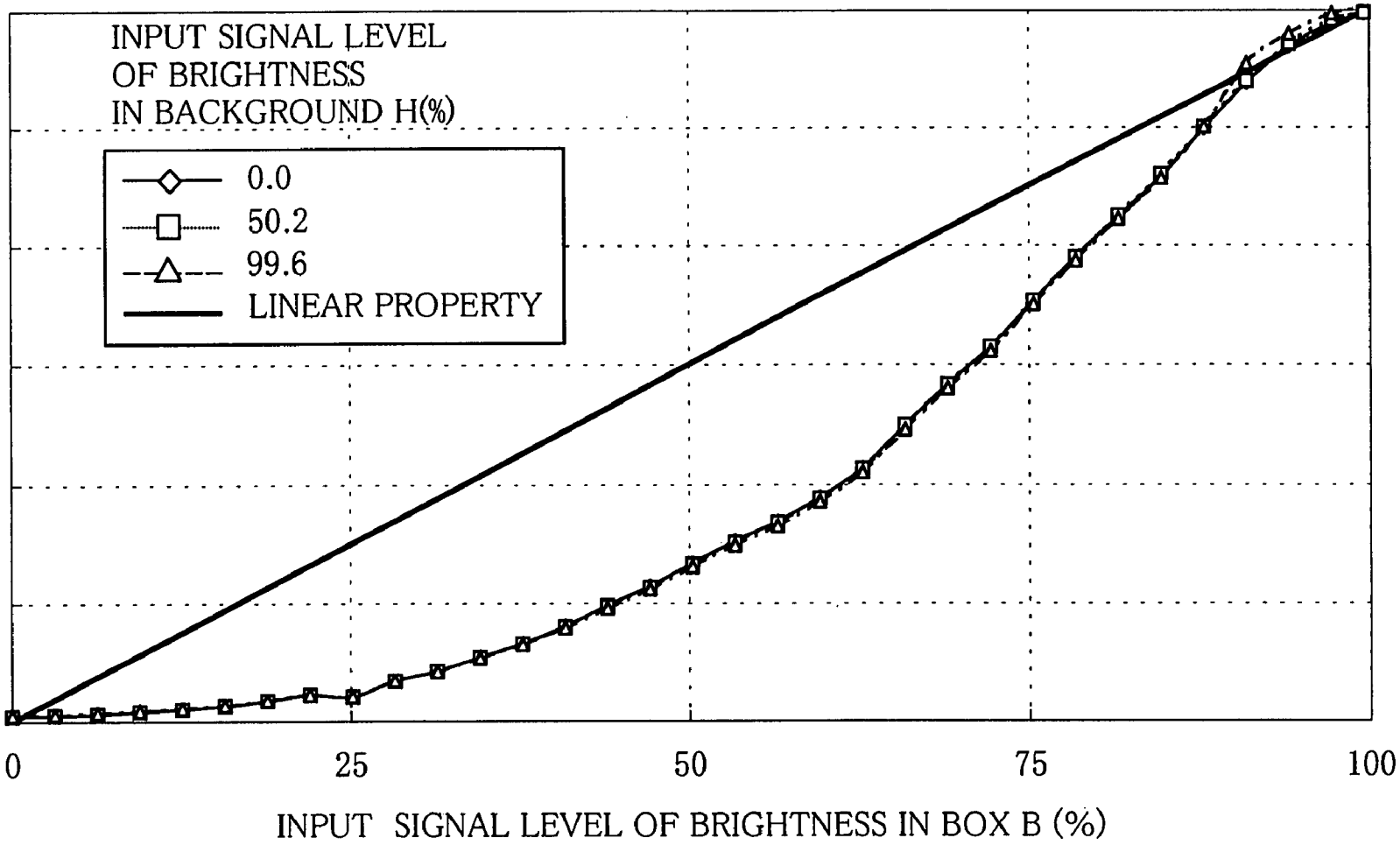
FIG. 11 is a graph showing variations in output brightness on a box with respect to an input signal level of brightness in the box when an input signal level of brightness in a background of a liquid crystal display device is constant.

Next, an input signal-output brightness property of a common liquid crystal display device was measured by the same processes used for a CRT display device. Note that, the liquid crystal display device used here was a liquid crystal display device for NTSC (National Television System Committee, USA) system display, and therefore, taking into account a difference in the number of display pixels, etc., between the liquid crystal display device and an HDTV, an area of the box is set to be about 1% of the area of the whole screen. The obtained measurement results which are normalized based on a maximum value are shown in FIG. 11. Note that, an input signal-output brightness property shown in FIG. 11, in the liquid crystal display device, refers to an input signal-output brightness property obtained as a result of the inverse gamma compensation of an input picture signal and the compensation of a voltage-optical transfer property (compensation for deviation from a linear property) of a liquid crystal, which were performed by a signal processing circuit in the liquid crystal display device. The input signal-output brightness property of the liquid crystal display device was substantially constant regardless of the average input signal level of brightness G (=the input signal level of brightness H in the background).

When showing the property of FIG. 11 by a non-linear exponential function in approximate representation, as with a CRT display device, an error becomes large in a portion having high brightness, so that approximate representation by sixth order polynomial is applied so as to perform processes.

Figure 12:
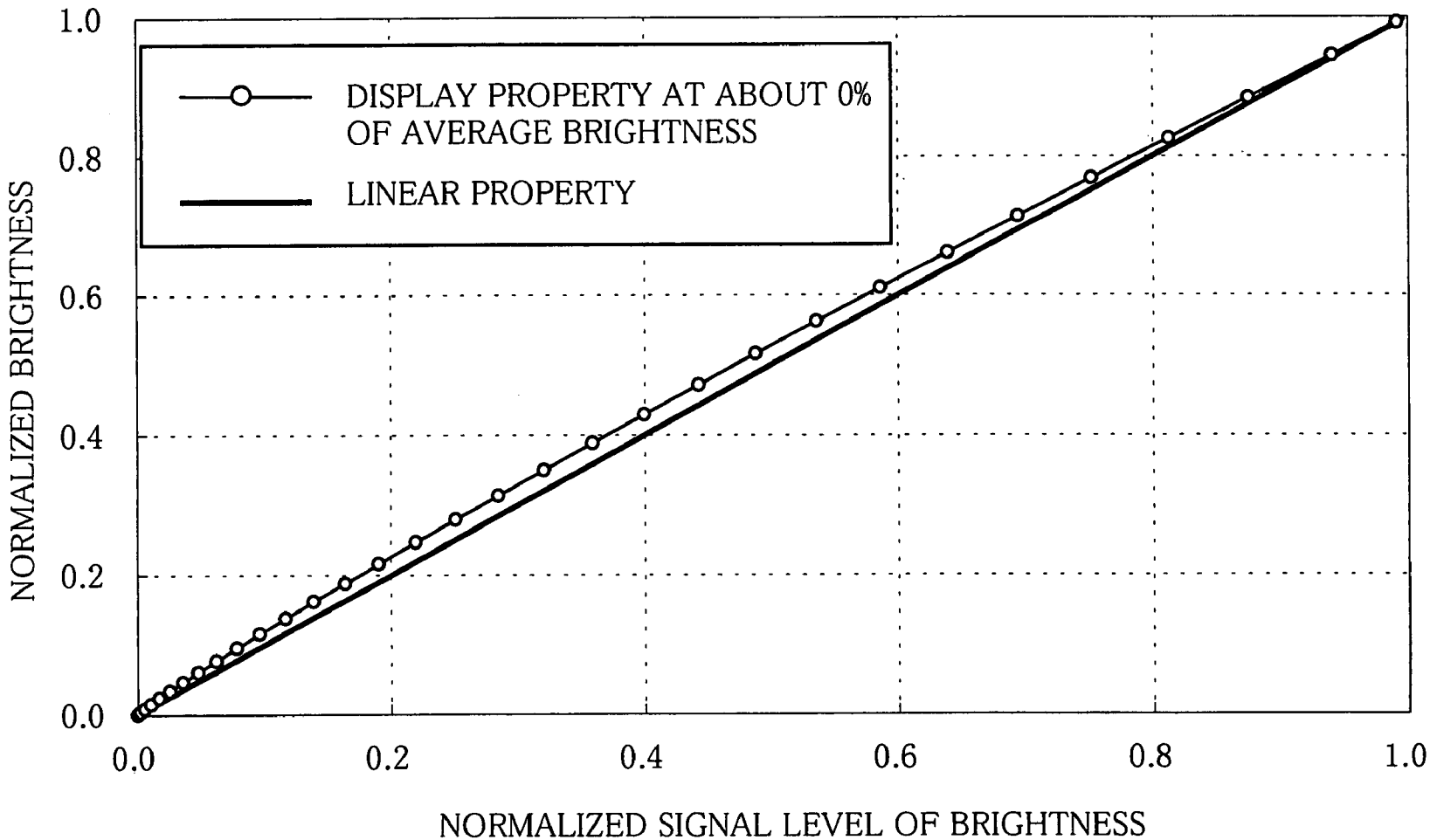
FIG. 12 is a graph showing an input signal-output brightness property of a liquid crystal display device when an average input signal level of brightness is 0%.
Figure 13:
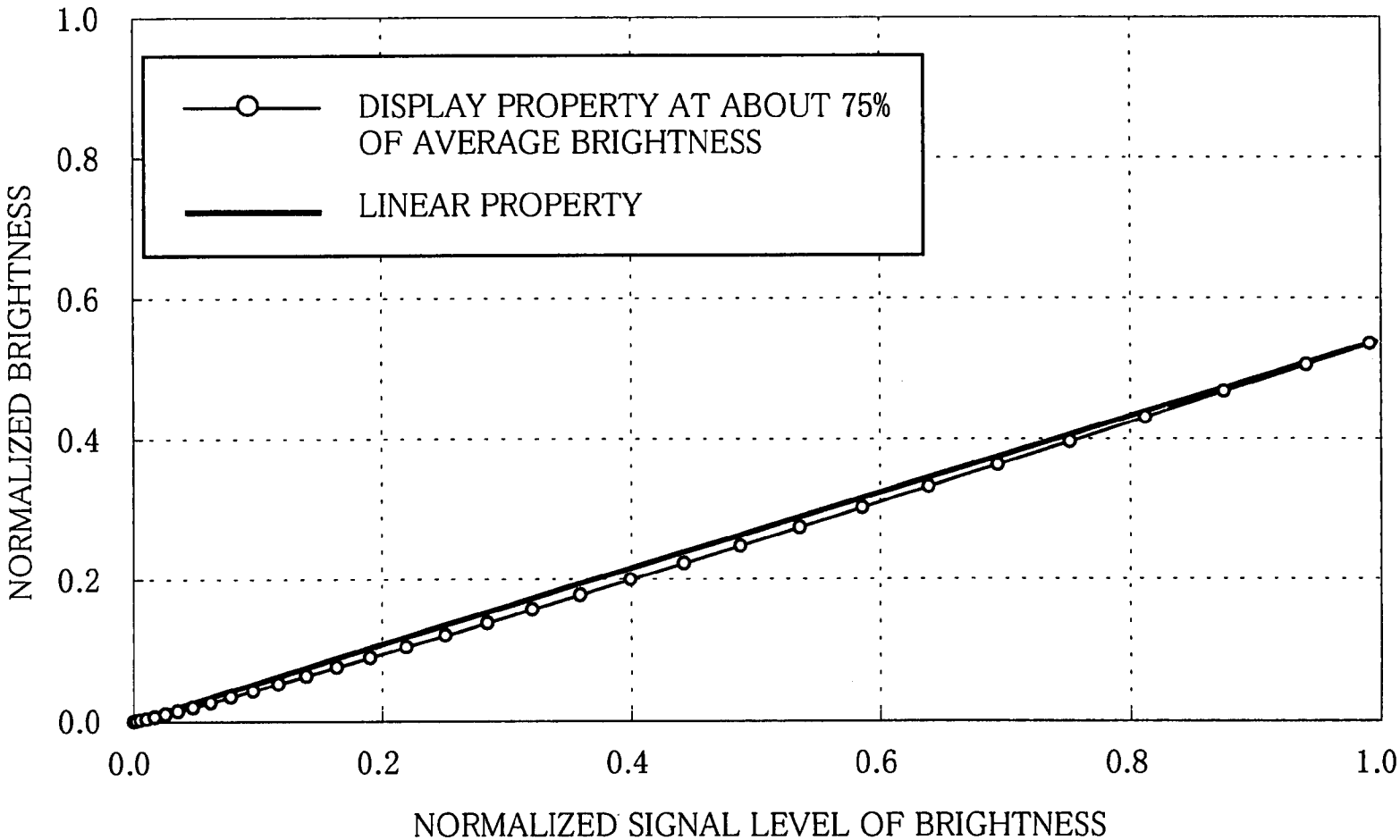
FIG. 13 is a graph showing an input signal-output brightness property of a liquid crystal display device when an average input signal level of brightness is 75%.

These input signal-output brightness properties are applied to the liquid crystal display device by a simulator through signal process shown in FIG. 3. FIG. 12 shows an input signal-output brightness property of the liquid crystal display device when an average input signal level of brightness G is substantially 0%, and FIG. 13 shows an input signal-output brightness property of the liquid crystal display device when an average input signal level of brightness G is around 75%.

In this process, the input signal-output brightness property of the liquid crystal display device as shown in FIG. 11 is converted into a linear property via the signal processes shown in equation (9). Therefore, the input signal-output brightness property shown in FIG. 10 is virtually realized in the liquid crystal display device.

A result of an evaluation of an actual image shows that the foregoing expected effect was obtained. Further, data corresponding to FIG. 10 were measured in a different display apparatus, and the resultant measurement data were stored in a memory device and the like, an image can be reproduced in an arbitrary display apparatus through the processes as shown in FIG. 1.

COMPARATIVE EXAMPLE 1

Figure 14:
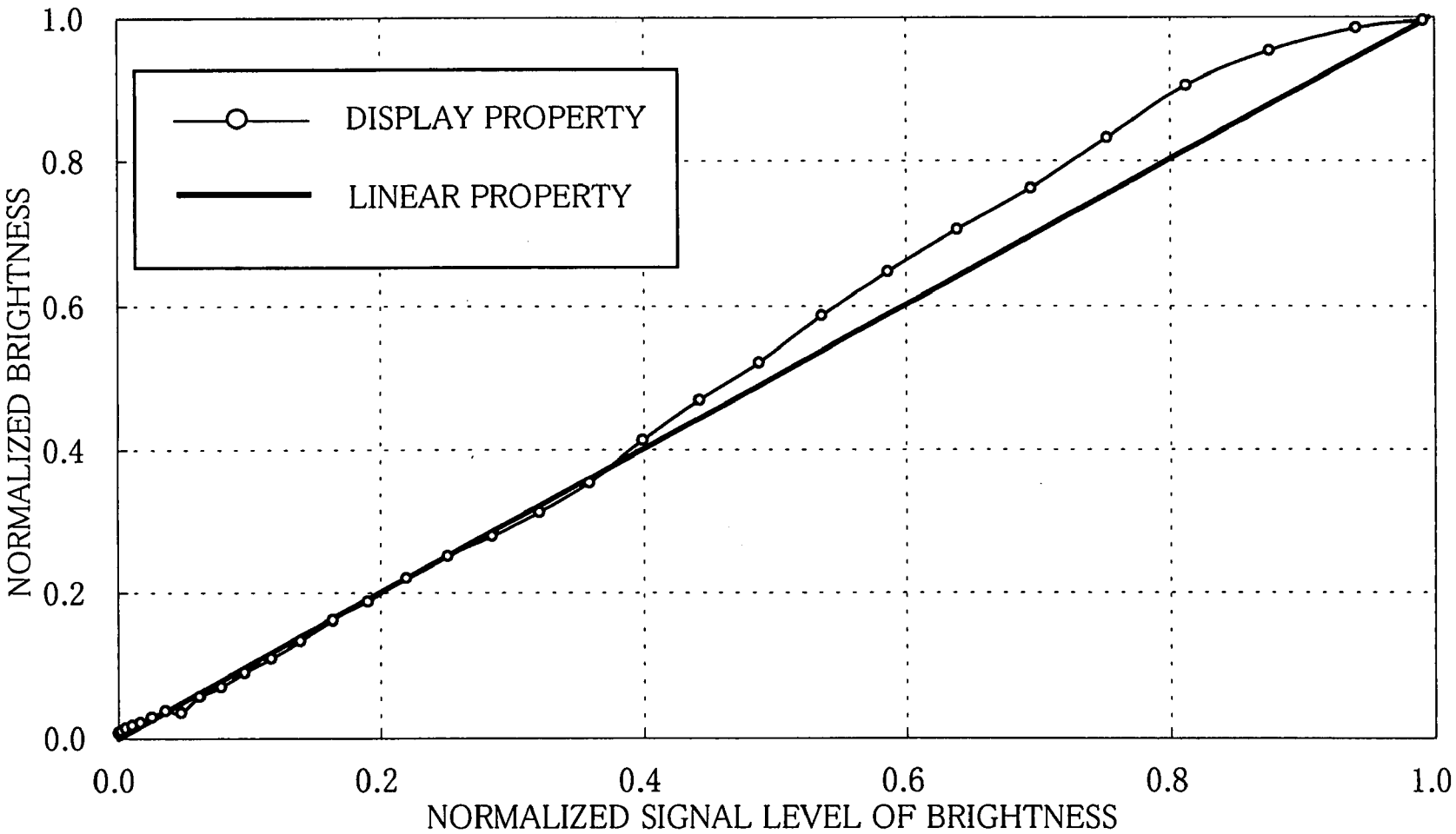
FIG. 14 is a graph showing an input signal-output brightness property of a liquid crystal display device where the present invention is not adopted.

FIG. 14 shows a display property of the liquid crystal display device adopted in Example 1, where the picture signal compensation device according to the present invention is not adopted, and an input picture signal as it is is inputted to the liquid crystal display device. Assuming that a picture signal subject to an inverse gamma compensation is inputted, when a display result (output brightness) of the liquid crystal display device presents a linear property with respect to an input level (optical intensity of an original image), it is held that the original image (an image which was picked up, etc.) has accurately been reproduced. In a display property shown in FIG. 14, since there is a relative increase in a level in a portion having high brightness of not less than 40%, it is highly feasible that such an image is recognized as being whitish or misted. Further, a result of an evaluation of an actual image shows that display was viewed as being entirely whitish compared to an image having a linear input signal-output brightness property. Moreover, because of this, it was felt that the image had a slightly pale color tone and that the texture of the image lacked freshness.

The embodiments and concrete examples of implementation discussed in the foregoing detailed explanation serve solely to illustrate the technical details of the present invention, which should not be narrowly interpreted within the limits of such embodiments and concrete examples, but rather may be applied in many variations within the spirit of the present invention, provided such variations do not exceed the scope of the patent claims set forth below.

What is claimed is:

1. An image reproducing method for reproducing an image by a display apparatus having a plurality of pixels based on a picture signal including a pixel signal representing information of each pixel, comprising the steps of:

performing an operation to obtain an average signal level which is an average level of all the pixel signals, then, setting an input signal-output brightness property which represents variations in brightness of a pixel with respect to the level of a pixel signal in accordance with the average signal level;

reproducing an image so that an exponential value of an exponential function approximately representing the input signal-output brightness property thus set increases with an increase of the average signal level; and reproducing the image so that maximum output brightness of a pixel of the display apparatus varies in accordance with the average signal level, wherein the image is reproduced so that the maximum output brightness becomes smaller as the average signal level increases, and the maximum output brightness is independent of gamma compensation calculated by the exponential function, wherein the image is reproduced by performing an operation to obtain the maximum output brightness of a pixel of the display apparatus from the average signal level, performing compensation of the picture signal subject to compensation in accordance with the input signal-output brightness property thus set based on a result of the operation to obtain the maximum output brightness, and feeding the display apparatus with the picture signal subject to compensation.

2. The method as set forth in claim 1, wherein:

when the pixel signal includes a brightness signal representing brightness information of each pixel, the average signal level is obtained by performing an operation to obtain an average level of all the brightness signals.

3. The method as set forth in claim 2, wherein:

in order to reproduce the image based on the picture signal including a brightness signal subject to compensation, the input signal-output brightness property which represents variations in brightness of a pixel with respect to the level of the brightness signal is set in accordance with the average signal level, and compensation is performed on the brightness signal so as to satisfy the input signal-output brightness property thus set.

4. The method as set forth in claim 1, wherein:

the image is reproduced by performing compensation on the picture signal so as to satisfy the input signal-output brightness property that is set, and outputting the picture signal subject to compensation to the display apparatus.

5. The method as set forth in claim 4, wherein:

the input signal-output brightness property is set by performing an operation to obtain an exponential value in which the input signal-output bright property is approximately represented by an exponential function from the average signal level, and compensation for the picture signal is made by performing compensation of the picture signal according to an input signal-output brightness property corresponding to the input signal-output brightness property that is set by the operation based on the exponential value, thereafter compensating for deviation from a linear property of the input signal-output brightness property of the display apparatus.

6. The method as set forth in claim 5, wherein:

the compensation for deviation from the linear property of the input signal-output brightness property of the display apparatus is performed by converting the pixel signal by an inverse function of a function which represents the input signal-output brightness property of the display apparatus.

7. The method as set forth in claim 1, wherein:

the picture signal to be employed in the operation for the average signal level is a color video signal including a brightness signal which represents brightness information of each pixel and a chromaticity signal which represents chromaticity information of each pixel.

8. The method as set forth in claim 1, wherein:

the picture signal to be employed in the operation for the average signal level is a color video signal including color component signals of three or more primary colors.

9. The method as set forth in claim 1, wherein:

as the display apparatus is adopted a display apparatus having an emission type optical switching element in which an emission element functions as an optical switching element as well.

10. The method as set forth in claim 1, wherein:

when the pixel signal includes a brightness signal which represents brightness information of each pixel, the operation for the average signal level is made by performing an operation to obtain an average level of all the brightness signals.

11. The method as set forth in claim 1, wherein:

as the display apparatus is adopted a display apparatus having an emission element and a non-emission type optical switching element, which is capable of separately controlling the emission element and the optical switching element.

12. An image display apparatus which includes a display section having a plurality of pixels for displaying an image and receives a picture signal including a pixel signal representing information of each pixel, comprising:

an average signal level operation section for performing an operation to obtain an average signal level which is an average level of all the pixel signals;

an input signal-output brightness property setting section for setting an input signal-output brightness property which represents variations in brightness of a pixel with respect to a level of the pixel signal in accordance with the average signal level;

a maximum output brightness adjustment section for adjusting maximum output brightness of the pixel of the display section in accordance with the average signal level;

a signal compensation section for performing compensation of a picture signal so as to satisfy the input signal-output brightness property thus set; and a signal conversion section for converting a picture signal subject to compensation in the signal compensation section based on an operational result of the maximum output brightness, so as to output the picture signal subject to conversion to the display apparatus, wherein:

the input signal-output brightness property setting section sets the input signal-output brightness property by performing an operation based on the average signal level so that an exponential value of an exponential function approximately representing the input signal-output brightness property increases with an increase of the average signal level;

the maximum output brightness adjustment section adjusts the maximum output brightness so that the maximum output brightness becomes smaller as the average signal level increases, and the maximum output brightness is independent of gamma compensation calculated by the exponential function;

the signal compensation section includes: a first signal compensation section for performing compensation of the pixel signal by the input signal-output brightness property corresponding to the input signal-output brightness property that is set by the operation based on the exponential value, and a second signal compensation section for compensating for deviation from a linear property of the input signal-output brightness property of the display section; and each pixel signal to be employed in operation of the average signal level operation section is a color video signal which includes a brightness signal representing brightness information of each pixel and a chromaticity signal representing chromaticity information of each pixel.

13. The image display apparatus as set forth in claim 12, wherein: the average signal level operation section performs an operation to obtain an average signal level which is an average level of all the brightness signals each of which is included in the picture signal to be inputted and represents brightness information of each pixel.

14. The image display apparatus as set forth in claim 13, wherein: the input signal-output brightness property setting section sets an input signal of brightness-output brightness property which represents variations in brightness of a pixel with respect to a level of the brightness signal in the pixel signal in accordance with the average signal level, and the signal compensation section performs compensation of the picture signal so as to satisfy the input signal of brightness-output brightness property thus set.

15. The image display apparatus as set forth in claim 12, further comprising:

a delay section for delaying output of the pixel signal of the inputted picture signal to the signal compensation section by time required to perform the operation for the average signal level and to set the input signal-output brightness property.

16. The image display apparatus as set forth in claim 12, wherein:

the second signal compensation section converts the pixel signal by an inverse function of a function representing the input signal-output brightness property of the display section.

17. The image display apparatus as set forth in claim 12, wherein:

the picture signal to be employed in the operation for the average signal level is a color video signal including color component signals of three or more primary colors.

18. The image display apparatus as set forth in claim 12, further comprising:

an emission type optical switching element in which an emission element functions as an optical switching element as well.

19. The image display apparatus as set forth in claim 12, further comprising an emission element and a non-emission type optical switching element, which are separately controlled.

20. A picture signal compensation device which receives a picture signal including a pixel signal representing information of each pixel, and performs compensation of the picture signal so as to output the picture signal subject to compensation to a display apparatus having a plurality of pixels, comprising:

an average signal level operation section for performing an operation to obtain an average signal level which is an average level of all the pixel signals;

an input signal-output brightness property setting section for setting an input signal-output brightness property which represents variations in brightness of a pixel with respect to a level of the pixel signal in accordance with the average signal level;

a maximum output brightness adjustment section for adjusting maximum output brightness of the pixel of the display section in accordance with the average signal level;

a signal compensation section for performing compensation of a picture signal so as to satisfy the input signal-output brightness property thus set; and a signal conversion section for converting a picture signal subject to compensation in the signal compensation section based on an operational result of the maximum output brightness, so as to output the picture signal subject to conversion to the display apparatus, wherein:

the input signal-output brightness property setting section sets the input signal-output brightness property by performing an operation based on the average signal level so that an exponential value of an exponential function approximately representing the input signal-output brightness property increases with an increase of the average signal level;

the maximum output brightness adjustment section adjusts the maximum output brightness so that the maximum output brightness becomes smaller as the average signal level increases, and the maximum output brightness is independent of gamma compensation calculated by the exponential function;

the signal compensation section includes: a first signal compensation section for performing compensation of the pixel signal by the input signal-output brightness property corresponding to the input signal-output brightness property that is set by the operation based on the exponential value, and a second signal compensation section for compensating for deviation from a linear property of the input signal-output brightness property of the display section; and each pixel signal to be employed in operation of the average signal level operation section is a color video signal which includes a brightness signal representing brightness information of each pixel and a chromaticity signal representing chromaticity information of each pixel.

21. The picture signal compensation device as set forth in claim 20, wherein:

the average signal level operation section performs an operation to obtain an average signal level which is an average level of all the brightness signals each of which is included in the picture signal to be inputted and represents brightness information of each pixel.

22. The picture signal compensation device as set forth in claim 20, wherein: the input signal-output brightness property setting section sets an input signal of brightness-output brightness property which represents variations in brightness of a pixel with respect to a level of the brightness signal in the pixel signal in accordance with the average signal level, and the signal compensation section performs compensation of the picture signal so as to satisfy the input signal of brightness-output brightness property thus set.

23. The image display apparatus as set forth in claim 20, further comprising:

a delay section for delaying output of the pixel signal of the inputted picture signal to the signal compensation section by time required to perform the operation for the average signal level and to set the input signal-output brightness property.

24. The picture signal compensation device as set forth in claim 20, wherein:

the second signal compensation section converts the pixel signal by an inverse function of a function representing the input signal-output brightness property of the display apparatus.

25. The picture signal compensation device as set forth in claim 20, wherein:

the picture signal to be employed in the operation for the average signal level is a color video signal including color component signals of three or more primary colors.

* * * * *